US010471576B2

(12) United States Patent
Totsu

(10) Patent No.: US 10,471,576 B2
(45) Date of Patent: Nov. 12, 2019

(54) AUTOMATIC SCREW TIGHTENING CONTROL METHOD AND DEVICE

(71) Applicant: Katsuyuki Totsu, Sumida-ku (JP)

(72) Inventor: Katsuyuki Totsu, Sumida-ku (JP)

( * ) Notice: Subject to any disclaimer, the term of this patent is extended or adjusted under 35 U.S.C. 154(b) by 1136 days.

(21) Appl. No.: 14/434,064

(22) PCT Filed: Sep. 25, 2013

(86) PCT No.: PCT/JP2013/075856
§ 371 (c)(1),
(2) Date: Apr. 7, 2015

(87) PCT Pub. No.: WO2014/065066
PCT Pub. Date: May 1, 2014

(65) Prior Publication Data

US 2015/0273671 A1 Oct. 1, 2015

(30) Foreign Application Priority Data

Oct. 26, 2012 (JP) ..... 2012-236697
Jan. 28, 2013 (JP) ..... 2013-013207

(51) Int. Cl.
*B25B 23/147* (2006.01)
*B25F 5/00* (2006.01)
(Continued)

(52) U.S. Cl.
CPC ..... *B25B 23/147* (2013.01); *B25B 21/00* (2013.01); *B25B 23/141* (2013.01); *B25F 5/001* (2013.01)

(58) Field of Classification Search
None
See application file for complete search history.

(56) References Cited

U.S. PATENT DOCUMENTS 5,154,242 A * 10/1992 Soshin ..... B25B 23/147 173/178
7,726,412 B2 * 6/2010 Matsunaga ..... B25B 23/141 173/176
2012/0063563 A1 3/2012 Huang et al.

FOREIGN PATENT DOCUMENTS

CN 102398244 A 4/2012
DE 10124674 A1 11/2002
(Continued)

*Primary Examiner* — Hemant Desai
*Assistant Examiner* — Tanzim Imam
(74) *Attorney, Agent, or Firm* — Norton Rose Fulbright US LLP

(57) ABSTRACT

In an electric driver configured such that a driver bit is coupled to a drive output shaft of an electric motor via a clutch mechanism to perform screw tightening operations, an automatic screw tightening control method and a device in which setting is performed such that an appropriate screw tightened state and various inappropriate screw tightened states in a screw tightening operation can be confirmed and determined, simply and reliably are provided.

In a screw tightening operation by an electric driver 10, at start of a predetermined screw tightening operation, a rotation amount Rm of an electric motor 12 at a clutch operation time by a clutch mechanism 18 is detected, this rotation amount is set to be a target rotation amount (including a permissible range) Rm±α, and in the subsequent screw tightening operations, a rotation amount Rt1 of the electric motor at the clutch operation time is detected and compared with the target rotation amount, respectively, so that acceptability of the respective screw tightened states is determined.

19 Claims, 10 Drawing Sheets

(51) Int. Cl.
*B25B 21/00* (2006.01)
*B25B 23/14* (2006.01)

(56) References Cited

FOREIGN PATENT DOCUMENTS

| | | | | | |
|---|---|---|---|---|---|
| EP | 1724065 | A1 | | 11/2006 | |
| JP | 53-15240 | | | 5/1978 | |
| JP | 63-260770 | A | | 10/1988 | |
| JP | 2-274475 | A | | 11/1990 | |
| JP | H2-274475 | A | | 11/1990 | |
| JP | 2010214564 | A | * | 9/2010 | ..... B25B 23/14 |
| JP | P2010-214564 | A | | 9/2010 | |
| WO | WO 2005/087441 | A1 | | 9/2005 | |

* cited by examiner

AUTOMATIC SCREW TIGHTENING CONTROL METHOD AND DEVICE

TECHNICAL FIELD

The present invention relates to an automatic screw tightening control method and a device in which in an electric driver configured such that a driver bit is coupled to a drive output shaft of an electric motor via a clutch mechanism to perform screw tightening operations, setting is performed such that an appropriate screw tightened state and various inappropriate screw tightened states in the screw tightening operations can be easily and reliably confirmed and determined.

BACKGROUND ART

Conventionally, a screw tightening device provided with various functions which can appropriately, smoothly and rapidly achieve the screw tightening operation is proposed and put into practice as a screw tightening device for performing the screw tightening operation by rotating/driving a driver bit by driving means such as an electric motor and the like.

For example, in the electric driver configured such that the driver bit is coupled to a drive output shaft of the electric motor via a clutch mechanism to perform screw tightening operations, when a screw is to be tightened to a screw hole provided in a required screw mounting target by the screw tightening device, a predetermined screw tightening torque value is reached in a state in which the screw is not completely screwed, and the clutch mechanism is operated so as to complete the screw tightening operation.

The applicant previously developed a screw tightening device which can detect defective screw tightening such as galling of the screw, screw lifting and the like with respect to the screw hole appropriately and reliably at a low cost by an easy and relatively simple configuration and filed a patent application (see Patent Document 1).

That is, the screw tightening device described in Patent Document 1 is configured such that, in a screw tightening device configured such that a screw tightening operation is performed by rotating/driving a rotary tool such as a driver bit and the like by driving means such as an electric motor and the like and a load torque generated in the rotary tool is detected with completion of screw tightening to a required screw mounting target, and when the load torque reaches a torque value set in advance, rotation/driving of the rotary tool is subjected to stop control, configured such that (1) rotation amount detecting means is provided on the rotary tool or driving means for detecting a rotation amount based on a rotation number or rotation time associated with rotation/driving of the rotary tool; and (2) at a point of time when a tip end of a screw shaft of a screw in which a screw head part is fitted with a tip end part of the rotary tool is positioned at and brought into contact with a screw hole of the screw mounting target, a screw-tightening reference time (t1) is set by screw-tightening reference time setting means by pressing the rotary tool in an axial direction.

Then, it is configured such that (3) after the screw-tightening reference time is set by the screw-tightening reference time setting means, screw-tightening start time (t2) is set by the screw-tightening start time setting means by starting the driving means of the rotary tool; (4) screw-tightening completion time (t3) when the screw positioned at and brought into contact with the screw hole by rotation/driving of the rotary tool is rotated, and the load torque generated in the rotary tool reaches the torque value set in advance is detected by screw-tightening completion time detecting means; and (5) after the screw-tightening reference time (t1) is set by the screw-tightening reference time setting means, from the screw-tightening start time (t2) when the driving means of the rotary tool is started by the screw-tightening start time setting means to the screw-tightening completion time (t3) detected by the screw-tightening completion time detecting means, it is determined whether or not a rotation amount of the rotary tool detected by the rotation amount detecting means is within a permissible range as compared with a reference value set in advance, and acceptability of the screw tightening is determined by screw-tightening acceptability determining means.

Moreover, in the screw tightening device described in Patent Document 1, it is disclosed that, a screw-tightening completion time detection signal when the clutch is operated by a torque setting clutch mechanism provided at a shaft coupling portion between a drive shaft of the driving means for rotating/driving the rotary tool and the rotary tool when a torque set value set in advance is reached is used or a screw-tightening completion time detection signal when a load current value set in advance is reached by, load current detecting means for detecting a load current of the electric motor for rotating/driving the rotary tool is used as the screw-tightening completion-time detecting means, respectively.

Moreover, the applicant developed a screw tightening device provided with an automatic stop device which can perform torque control by automatically stopping driving of the electric driver driving the rotary tool by detecting a load current of the electric motor without providing the above-described clutch mechanism in a prior art (see Patent Document 2), which was granted a patent.

That is, the screw tightening device provided with the automatic stop device described in Patent Document 2 is configured such that, if the electric motor is rotated/driven in a certain state, in the screw tightening operation, a load current when the drive shaft of the electric motor is rotated/driven becomes an overload current by a reaction force in proportion with a screw tightening torque value imparted to the drive shaft and thus, when the overload current in proportion with the screw tightening torque value set in advance reaches a required value, this state is detected, and a power supply of the electric motor is shut off so as to automatically stop the electric driver.

PRIOR ART DOCUMENTS

Patent Documents

Patent Document 1: JP 2010-214564 A
Patent Document 2: JP 53-15240 B

SUMMARY OF THE INVENTION

Problems to be Solved by the Invention

As described above, in the screw tightening device described in the above-described Patent Document 1, the screw-tightening reference time (t1) is set, and it is determined whether or not the rotation amount of the rotary tool detected by the rotation amount detecting means from the screw-tightening start time (t2) to the screw-tightening completion time (t3) is within the permissible range as compared with the reference value set in advance so that defective screw tightening such as galling of the screw, screw lifting and the like with respect to the screw hole can be detected appropriately and reliably at a low cost by an easy and relatively simple configuration.

However, in the above-described screw tightening device, in each of the screw tightening operations, the screw-tightening reference time (t1) is set, and the rotation amount of the rotary tool detected by the rotation amount detecting means is detected from the screw-tightening start time (t2) to the screw-tightening completion time (t3), and thus, attention should be paid to a work of setting the screw-tightening reference time (t1) at all times, and though there is no particular problem with skilled workers, there can be a case in which appropriate operation effects and operation efficiency which should have been exerted in the above-described invention cannot be gained in the screw-tightening operation by unskilled workers.

Thus, the inventor paid attention to a configuration of an electric driver in which, in the electric driver employing a clutch mechanism proposed in various ways in the past as described above, a rotation amount detecting means for detecting a rotation amount of the electric motor is provided in a control circuit of the electric motor for rotating/driving a driver bit and in the screw tightening operation, the rotation amount of the electric motor is set to be detected and recorded, and a control portion is provided for detecting a state in which the screw tightening is completed by a clutch operation of the clutch mechanism and for sequentially detecting or recording the rotation amount at this clutch operation time from the screw-tightening start time of the electric motor.

That is, in the present invention, at the start time when the predetermined screw tightening operation is performed by using the electric driver having the above-described configuration, detection of the rotation amount of the electric motor by the rotation amount detecting means is started by performing an appropriate screw tightening operation (first session) in advance, then, the state in which the screw tightening is completed is detected by the clutch operation of the clutch mechanism, the rotation amount of the electric motor from the screw-tightening start time at this clutch operation time is detected/recorded, and this detected/recorded rotation amount is set to be a target rotation amount. Then, it was found that, in the subsequent predetermined screw tightening operations (second session and after), the rotation amount from the start time of the screw tightening operation until when the screw tightening is completed and the clutch operation time of the clutch mechanism is reached is sequentially detected, the rotation amount detected at the clutch operation time is compared with the target rotation amount, and if the rotation amount matches the target rotation amount (including a permissible range), it is determined to be an appropriate screw tightened state, while if the rotation amount does not match the target rotation amount (including the permissible range), it can be determined that the screw tightened state is defective or abnormal easily and reliably.

If the rotation amount of the electric motor sequentially detected until the clutch operation time in the respective predetermined screw tightening operations is compared with the target rotation amount set in advance as above, it can be so configured that the rotation amount of the electric motor detected until the clutch operation time in the predetermined screw tightening operation is calculated so as to be sequentially added from the set value of the target rotation amount, and the final detected value of the rotation amount is compared with the set value of the target rotation amount (including the permissible range).

As an alternative, if the rotation amount of the electric motor sequentially detected until the clutch operation time in the respective predetermined screw tightening operations is compared with a first target rotation amount set in advance as described above, it can be so configured that the rotation amount of the electric motor detected until the clutch operation time in the predetermined screw tightening operation is calculated so as to be sequentially subtracted from the set value of the first target rotation amount, a second target rotation amount is set to finally become 0 (including the permissible range), and the detected value of the rotation amount is compared with the set value of the second target rotation amount (including the permissible range).

In the present invention, in the electric driver configured as above, it was found that load current detecting means is provided and set for detecting/recording a load current value in proportion with a screw tightening torque value, and together with the rotation amount detecting means for detecting/recording the rotation amount of the electric motor, in the clutch operation of the clutch mechanism, the rotation amount of the electric motor and the load current value are detected and compared with the target rotation amount (including the permissible range) set in advance and also compared with a target load current value (including the permissible range) set in advance, whereby acceptability of the screw tightened state is determined, and moreover, the load current value in the clutch operation is detected so that the determination result can be set to be displayed.

Moreover, in the present invention, it was found that, without providing rotation amount detecting means for detecting/recording the rotation amount of the electric motor, the load current detecting means is provided and set so as to detect/record a load current value in proportion with a screw tightening torque value, and in the clutch operation of the clutch mechanism, acceptability of the screw tightened state is determined by making comparison with a target load current value (including the permissible range) set in advance, and moreover, the load current value in the clutch operation is detected so that the determination result can be set to be displayed.

Furthermore, in the present invention, it was found that, in the predetermined screw tightening operation by the electric driver, also by setting the rotation amount of the electric motor at the clutch operation time by the clutch mechanism associated with completion of screw tightening from the screw-tightening start time scheduled by an advance trial or the like based on a standard of a screw to be used in advance to be a target rotation amount (including the permissible range), in the predetermined screw tightening operation, the rotation amount of the electric motor from the screw-tightening start time to the clutch operation time by the clutch mechanism associated with completion of the screw tightening is sequentially detected by the rotation amount detecting means, and the rotation amount detected at the clutch operation time is compared with the target rotation amount (including the permissible range) so that determination of acceptability of the screw tightened state can be appropriately achieved.

In the above-described present invention, in the electric driver, by providing a push-operation switch or an encoder operated by displacement in an axial direction at contact of the driver bit with the screw mounting target so as to detect an operation signal of the push-operation switch or encoder, it can be set to be the screw-tightening start time when the screw tightening operation is performed.

As described above, by setting the screw-tightening start time when the screw tightening operation is performed, the drive switch for driving the electric motor is operated by a switch operating member and at the same time, the rotation amount of the electric motor is detected by the rotation amount detecting means when the rotation amount of the electric motor detected by the rotation amount detecting means is detected/recorded in the screw tightening operation by the electric driver. As a result, if the driver bit is made to idle until it is brought into contact with the screw mounting target, for example, the rotation amount detected at timing of this idling makes the rotation amount of the electric motor while the screw tightening operation is actually performed inaccurate, and thus, by setting the screw-tightening start time as above, the rotation amount of the electric motor during the actual screw tightening operation can be detected accurately.

Moreover, as described above, by detecting the operation signal of the push-operation switch or encoder, first, by bringing the driver bit to the screw mounting target and by detecting the operation signal of the push-operation switch or encoder at this time, the screw-tightening start time when the screw tightening operation is performed is set, and then, by operating the drive switch for driving the electric motor by the switch operating member, the rotation amount of the electric motor while the screw tightening operation is actually performed until the screw is seated can be accurately detected.

Therefore, according to the present invention, as seen in a micrometer, in a precision screw, with improvement of working accuracy relating to a pitch dimension of the screw, in combination of improvement of detection accuracy of the above-described screw rotation amount, position setting with a relation between the screw rotation amount and a movement distance of the screw shaft in screw tightening corresponding to each other with high accuracy is made possible, and as a result, the relation between a position where the screw is appropriately seated with respect to the mounting target in screw tightening and the rotation amount can be accurately set and confirmed, and sufficient improvement of reliability of acceptability determination in the screw tightening operation was confirmed.

Therefore, an object of the present invention is to provide an automatic screw tightening control method and device in which, in the electric driver configured such that the driver bit is coupled to the drive output shaft of the electric motor through the clutch mechanism to perform the screw tightening operation, setting is performed such that confirmation and determination can be made simply and reliably for an appropriate screw tightened state and various inappropriate screw tightened states in the screw tightening operations.

Means for Solving the Problems

In order to achieve the above-described object, an automatic screw tightening control method described in claim 1 of the application as filed is characterized in that:

an electric driver provided with an electric motor, a drive switch for driving this electric motor, and a driver bit coupled to a drive output shaft of the electric motor via a reduction gear mechanism and a clutch mechanism and provided with a switch operating member for operating the drive switch, a clutch operation detection sensor for detecting a clutch operation of the clutch mechanism, an electric motor control circuit for executing driving and stop control of the electric motor, and rotation amount detecting means for detecting a rotation amount of the electric motor, respectively, is used;

in a predetermined screw tightening operation by the electric driver, the rotation amount of the electric motor at clutch operation time by the clutch mechanism associated with completion of the screw tightening from screw-tightening start time in the first screw tightening operation is detected/recorded by the rotation amount detecting means, and the detected/recorded rotation amount is set to be a target rotation amount (including a permissive range); and in the subsequent predetermined screw tightening operations, it is set that the rotation amount of the electric motor from the screw-tightening start time until the clutch operation time by the clutch mechanism associated with completion of the screw tightening is sequentially detected by the rotation amount detecting means and the rotation amount detected at the clutch operation time is compared with the target rotation amount (including the permissible range), whereby acceptability of the screw tightened state is determined.

An automatic screw tightening control method described in claim 2 of the application as filed is characterized in that:

an electric driver provided with an electric motor, a drive switch for driving this electric motor, and a driver bit coupled to a drive output shaft of the electric motor via a reduction gear mechanism and a clutch mechanism and provided with a switch operating member for operating the drive switch, a clutch operation detection sensor for detecting a clutch operation of the clutch mechanism, an electric motor control circuit for executing driving and stop control of the electric motor, a rotation amount detecting means for detecting a rotation amount of the electric motor, and load current detecting means for detecting a load current obtained in the electric motor on the basis of a load torque (reaction force) imparted to the driver bit in the electric motor control circuit, respectively, is used;

in a predetermined screw tightening operation by the electric driver, the rotation amount of the electric motor at clutch operation time by the clutch mechanism associated with completion of the screw tightening from screw-tightening start time in the first screw tightening operation is detected/recorded by the rotation amount detecting means, and the detected/recorded rotation amount is set to be a target rotation amount (including a permissive range), a load current value in proportion with a screw tightening torque value of the electric motor detected by the load current detecting means is detected/recorded, and this detected/recorded load current value is set to be a target load current value (including the permissive range); and in the subsequent predetermined screw tightening operations, it is set that the rotation amount of the electric motor from the screw-tightening start time until the clutch operation time by the clutch mechanism associated with completion of the screw tightening is sequentially detected by the rotation amount detecting means and the rotation amount detected at the clutch operation time is compared with the target rotation amount (including the permissible range), and a load current value from the screw-tightening start time to the clutch operation time by the clutch mechanism associated with completion of the screw tightening is sequentially detected by the load current detecting means, and the load current value detected at the clutch operation time is also compared with the target load current value (including the permissible range) whereby acceptability of the screw tightened state is determined.

An automatic screw tightening control method described in claim 3 of the application as filed is characterized in that:

an electric driver provided with an electric motor, a drive switch for driving this electric motor, and a driver bit coupled to a drive output shaft of the electric motor via a reduction gear mechanism and a clutch mechanism and provided with a switch operating member for operating the drive switch, a clutch operation detection sensor for detecting a clutch operation of the clutch mechanism, an electric motor control circuit for executing driving and stop control of the electric motor, and load current detecting means for detecting a load current obtained in the electric motor on the basis of a load torque (reaction force) imparted to the driver bit in the electric motor control circuit, respectively, is used;

in a screw tightening operation by the electric driver, a load current value in proportion with the screw tightening torque value of the electric motor at clutch operation time by the clutch mechanism associated with completion of the screw tightening from screw-tightening start time in the first screw tightening operation is detected/recorded by the load current detecting means, and this detected/recorded load current value is set to be a target load current value (including the permissive range); and in the subsequent predetermined screw tightening operations, it is set that the load current value in proportion with the torque value of the screw-tightening electric motor from the screw-tightening start time until the clutch operation time by the clutch mechanism associated with completion of the screw tightening is sequentially detected by the load current detecting means and the load current value detected at the clutch operation time is compared with the target load current value (including the permissible range), whereby acceptability of the screw tightened state is determined.

An automatic screw tightening control method described in claim 4 of the application as filed is characterized in that:

an electric driver provided with an electric motor, a drive switch for driving this electric motor, and a driver bit coupled to a drive output shaft of the electric motor via a reduction gear mechanism and a clutch mechanism and provided with a switch operating member for operating the drive switch, a clutch operation detection sensor for detecting a clutch operation of the clutch mechanism, an electric motor control circuit for executing driving and stop control of the electric motor, and rotation amount detecting means for detecting a rotation amount of the electric motor, respectively, is used;

in a predetermined screw tightening operation by the electric driver, the rotation amount of the electric motor at the clutch operation time by the clutch mechanism associated with completion of the screw tightening from screw-tightening start time scheduled on the basis of a standard of the screw to be used in advance is set to be a target rotation amount (including the permissible range); and in the predetermined screw tightening operation, it is set that he rotation amount of the electric motor from the screw-tightening start time until the clutch operation time by the clutch mechanism associated with completion of the screw tightening is sequentially detected by the rotation amount detecting means and the rotation amount detected at the clutch operation time is compared with the target rotation amount (including the permissible range), whereby acceptability of the screw tightened state is determined.

An automatic screw tightening control method described in claim 5 of the application as filed is characterized in that:

in a predetermined screw tightening operation, when a rotation amount of the electric motor sequentially detected from the screw-tightening start time to the clutch operation time is compared with the target rotation amount (including the permissible range), it is so configured that the rotation amount of the electric motor detected until the clutch operation time in the predetermined screw tightening operation is calculated so as to be sequentially added from the set value of the target rotation amount, and the final detected value of the rotation amount is compared with the set value of the target rotation amount (including the permissible range).

An automatic screw tightening control method described in claim 6 of the application as filed is characterized in that:

in a predetermined screw tightening operation, when a rotation amount of the electric motor sequentially detected from the screw-tightening start time to the clutch operation time is compared with the first target rotation amount (including the permissible range), it is so configured that the rotation amount of the electric motor detected until the clutch operation time in the predetermined screw tightening operation is calculated so as to be sequentially subtracted from a set value of the first target rotation amount, a second target rotation amount is set to finally become 0 (including the permissible range), and the final detected value of the rotation amount is compared with the set value of the second target rotation amount (including the permissible range).

An automatic screw tightening control method described in claim 7 of the application as filed is characterized in that:

in the electric driver, a push-operation switch or an encoder operated by displacement in an axial direction at contact of the driver bit with a screw mounting target is provided, the screw-tightening start time when the screw tightening operation is performed is set by an operation signal of the push-operation switch or encoder.

An automatic screw tightening control method described in claim 8 of the application as filed is characterized in that:

if the rotation amount of the electric motor detected at the clutch operation time matches the target rotation amount (including the permissible range) set in advance, and/or if the load current detected value detected at the clutch operation time matches the target load current value (including the permissible range) set in advance, the screw tightened state is set to be determined to be appropriate.

An automatic screw tightening control method described in claim 9 of the application as filed is characterized in that:

if the rotation amount of the electric motor at the clutch operation time or non-operation time does not match the target rotation amount (including the permissible range) set in advance, and/or if the load current detected value at the clutch operation time does not match the target load current value (including the permissible range) set in advance, the screw tightened state is set to be determined to be defective.

An automatic screw tightening control method described in claim 10 of the application as filed is characterized in that:

if the rotation amount of the electric motor detected at the clutch operation time and/or the load current detected value detected at the clutch operation time matches the target rotation amount (including the permissible range) and/or the target load current value (including the permissible range), respectively, the number of the screws and/or a length dimension of the screw determined that the screw tightened state is appropriate is set to be detected/recorded.

An automatic screw tightening control method described in claim 11 of the application as filed is characterized in that:

if the screw tightened state detected at the clutch operation time is determined to be appropriate or defective, the respective states are set to be distinguished and displayed on a display.

An automatic screw tightening control method described in claim 12 of the application as filed is characterized in that:

an electric drivers provided with an electric motor, a drive switch for driving this electric motor, and a driver bit coupled to a drive output shaft of the electric motor via a reduction gear mechanism and a clutch mechanism and provided with a switch operating member for operating the drive switch, a clutch operation detection sensor for detecting a clutch operation of the clutch mechanism, an electric motor control circuit for executing driving and stop control of the electric motor, rotation amount detecting means for detecting a rotation amount of the electric motor, and load current detecting means for detecting a load current obtained in the electric motor on the basis of a load torque (reaction force) imparted to the driver bit in the electric motor control circuit, respectively, is used;

in a predetermined screw tightening operation by the electric driver, at the clutch operation time by the clutch mechanism associated with completion of the screw tightening from the screw-tightening start time and/or when the load current value detected by the load current detecting means reaches the target load current value associated with completion of the screw tightening set in advance, a rotation amount of the electric motor sequentially detected by the rotation amount detecting means is detected, and the target load current value (including the permissible range) associated with completion of the screw tightening and a target rotation amount (including the permissible range) set in advance as a rotation amount of the electric motor are compared, whereby acceptability of the screw tightened state is set to be determined.

An automatic screw tightening control device described in claim 13 of the application as filed is characterized in that:

an electric driver provided with an electric motor, a drive switch for driving this electric motor, and a driver bit coupled to a drive output shaft of the electric motor via a reduction gear mechanism and a clutch mechanism and provided with a switch operating member for operating the drive switch, a clutch operation detection sensor for detecting a clutch operation of the clutch mechanism, an electric motor control circuit for executing driving and stop control of the electric motor, and rotation amount detecting means for detecting a rotation amount of the electric motor, respectively, is used;

a control portion is provided which is set such that, in a predetermined screw tightening operation by the electric driver, a rotation amount of the electric motor at clutch operation time by the clutch mechanism associated with completion of the screw tightening from screw-tightening start time in the first screw tightening operation is detected/recorded by the rotation amount detecting means, and the detected/recorded rotation amount is set to be a target rotation amount (including a permissive range); and in the subsequent predetermined screw tightening operations, the rotation amount of the electric motor from the screw-tightening start time until the clutch operation time by the clutch mechanism associated with completion of the screw tightening is sequentially detected by the rotation amount detecting means and the rotation amount detected at the clutch operation time is compared with the target rotation amount (including the permissible range), whereby acceptability of the screw tightened state is determined.

An automatic screw tightening control device described in claim 14 of the application as filed is characterized in that:

an electric driver provided with an electric motor, a drive switch for driving this electric motor, and a driver bit coupled to a drive output shaft of the electric motor via a reduction gear mechanism and a clutch mechanism and provided with a switch operating member for operating the drive switch, a clutch operation detection sensor for detecting a clutch operation of the clutch mechanism, an electric motor control circuit for executing driving and stop control of the electric motor, rotation amount detecting means for detecting a rotation amount of the electric motor, and load current detecting means for detecting a load current obtained in the electric motor on the basis of a load torque (reaction force) imparted to the driver bit in the electric motor control circuit, respectively, is provided;

a control portion is provided which is set such that, in a predetermined screw tightening operation by the electric driver, the rotation amount of the electric motor at clutch operation time by the clutch mechanism associated with completion of the screw tightening from screw-tightening start time in the first screw tightening operation is detected/recorded by the rotation amount detecting means, and this detected/recorded rotation amount is set to be a target rotation amount (including a permissive range), a load current value in proportion with a screw tightening torque value of the electric motor detected by the load current detecting means is detected/recorded, and this detected/recorded load current value is set to be a target load current value (including the permissive range); and in the subsequent predetermined screw tightening operations, the rotation amount of the electric motor from the screw-tightening start time until the clutch operation time by the clutch mechanism associated with completion of the screw tightening is sequentially detected by the rotation amount detecting means and the rotation amount detected at the clutch operation time is compared with the target rotation amount (including the permissible range) and the load current value from the screw-tightening start time to the clutch operation time by the clutch mechanism associated with completion of the screw tightening is sequentially detected by the load current detecting means, and the load current value detected at the clutch operation time is also compared with the target load current value (including the permissible range) whereby acceptability of the screw tightened state is determined.

An automatic screw tightening control device described in claim 15 of the application as filed is characterized in that:

an electric driver provided with an electric motor, a drive switch for driving this electric motor, and a driver bit coupled to a drive output shaft of the electric motor via a reduction gear mechanism and a clutch mechanism and provided with a switch operating member for operating the drive switch, a clutch operation detection sensor for detecting a clutch operation of the clutch mechanism, an electric motor control circuit for executing driving and stop control of the electric motor, and load current detecting means for detecting a load current obtained in the electric motor on the basis of a load torque (reaction force) imparted to the driver bit in the electric motor control circuit, respectively, is provided;

a control portion is provided which is set such that, in a screw tightening operation by the electric driver, a load current value in proportion with the screw tightening torque value of the electric motor at clutch operation time by the clutch mechanism associated with completion of the screw tightening from screw-tightening start time in the first screw tightening operation is detected/recorded by the load current detecting means, and this detected/recorded load current value is set to be a target load current value (including the permissive range); and in the subsequent predetermined screw tightening operations, the load current value in proportion with the torque value of the screw-tightening electric motor from the screw-tightening start time until the clutch operation time by the clutch mechanism associated with completion of the screw tightening is sequentially detected by the load current detecting means and the load current value detected at the clutch operation time is compared with the target load current value (including the permissible range), whereby acceptability of the screw tightened state is determined.

An automatic screw tightening control device described in claim 16 of the application as filed is characterized in that:

an electric driver provided with an electric motor, a drive switch for driving this electric motor, and a driver bit coupled to a drive output shaft of the electric motor via a reduction gear mechanism and a clutch mechanism and provided with a switch operating member for operating the drive switch, a clutch operation detection sensor for detecting a clutch operation of the clutch mechanism, an electric motor control circuit for executing driving and stop control of the electric motor, and rotation amount detecting means for detecting a rotation amount of the electric motor, respectively, is provided;

a control portion is provided which is set such that, in a predetermined screw tightening operation by the electric driver, the rotation amount of the electric motor at the clutch operation time by the clutch mechanism associated with completion of the screw tightening from screw-tightening start time scheduled on the basis of a standard of the screw to be used in advance is set to be a target rotation amount (including the permissible range); and in the predetermined screw tightening operation, the rotation amount of the electric motor from the screw-tightening start time until the clutch operation time by the clutch mechanism associated with completion of the screw tightening is sequentially detected by the rotation amount detecting means and the rotation amount detected at the clutch operation time is compared with the target rotation amount (including the permissible range), whereby acceptability of the screw tightened state is determined.

An automatic screw tightening control device described in claim 17 of the application as filed is characterized in that:

in the electric driver, a push-operation switch or an encoder operated by displacement in an axial direction at contact of the driver bit with a screw mounting target is provided, and the screw-tightening start time when the screw tightening operation is performed is configured to be set by an operation signal of the push-operation switch or encoder.

An automatic screw tightening control device described in claim 18 of the application as filed is characterized in that:

in the control portion, it is so configured that if the rotation amount of the electric motor detected at the clutch operation time and/or the load current detected value detected at the clutch operation time matches the target rotation amount (including the permissible range) and/or the target load current value (including the permissible range), respectively, the number of the screws and/or a length dimension of the screw determined that the screw tightened state is appropriate is detected/recorded.

An automatic screw tightening control device described in claim 19 of the application as filed is characterized in that:

a display for displaying a determination result of acceptability of the screw tightened state obtained in the control portion in the respective states is provided.

Effect of the Invention

According to the automatic screw tightening control method and the device described in claims 1 and 13 of the present invention, when the clutch operation by the clutch mechanism is detected by the clutch operation detection sensor by using the electric driver constituted by coupling the driver bit to the drive output shaft of the electric motor via the clutch mechanism to perform a screw tightening operation, by configuring such that a rotation amount based on a rotation amount detection signal obtained by the rotation amount detecting means of the electric motor is detected, the target rotation amount (including the permissible range) is set, and by making comparison with the target rotation amount (including the permissible range) set in the subsequent screw tightening operations, acceptability of the screw tightened state can be determined easily and simply, and an appropriate screw tightened state in the screw tightening operation can be confirmed and determined reliably. Therefore, according to the present invention, even unskilled workers of the screw tightening operation can achieve easy and accurate screw tightening operation.

According to the automatic screw tightening control method and the device described in claims 2 and 14 of the present invention, in the above-described configuration of the electric driver, when the clutch operation by the clutch mechanism is detected by the clutch operation detection sensor, by configuring a load current value based on a load current detection signal obtained by the load current detecting means in the electric motor control circuit to be detected, a target load current value (including the permissible range) is set in addition to the target rotation amount (including the permissible range) set in advance, respectively, and by making comparison with the target rotation amount (including the permissible range) and the target load current value (including the permissible range), respectively, acceptability of the screw tightened state can be determined easily and simply similarly to the above, and an appropriate screw tightened state in the screw tightening operation can be confirmed and determined reliably.

According to the automatic screw tightening control method and the device described in claims 3 and 15 of the present invention, in the above-described configuration of the electric driver, when the clutch operation by the clutch mechanism is detected by the clutch operation detection sensor instead of the rotation amount detecting means for detecting the rotation amount of the electric motor, by configuring such that a load current value based on a load current detection signal obtained by the load current detecting means in the electric motor control circuit is detected, a target load current value (including the permissible range) is set, and by making comparison with the target load current value (including the permissible range) set in the subsequent screw tightening operations, acceptability of the screw tightened state can be determined easily and simply similarly to the above, and an appropriate screw tightened state in the screw tightening operation can be confirmed and determined reliably.

According to the automatic screw tightening control method and the device described in claims 4 and 16 of the present invention, similarly to the automatic screw tightening control method and the device described in the above-described claims 1 and 12, when the clutch operation by the clutch mechanism is detected by the clutch operation detection sensor by using the electric driver constituted by coupling the driver bit to the drive output shaft of the electric motor via the clutch mechanism to perform a screw tightening operation, by configuring such that a rotation amount based on a rotation amount detection signal obtained by the rotation amount detecting means of the electric motor is detected, the target rotation amount (including the permissible range) is set, and by making comparison with the target rotation amount (including the permissible range) set in the subsequent screw tightening operations, acceptability of the screw tightened state can be determined easily and simply, and an appropriate screw tightened state in the screw tightening operation can be confirmed and determined reliably. Therefore, according to the present invention, even unskilled workers of the screw tightening operation can achieve easy and accurate screw tightening operation.

According to the automatic screw tightening control method and the device described in any one of claims 5, 6, 7, and 17 of the present invention, the rotation amount of the electric motor during the screw tightening operation is actually performed can be detected accurately, whereby detection of various abnormal states of screw tightening can be facilitated, and an appropriate screw tightened state in the screw tightening operation can be confirmed and determined reliably. In this way, according to the present invention, integration of data or image processing relating to control detected in a clutch-type electric driver in use can be achieved smoothly and easily, whereby a control data processing function as the electric driver can be improved.

According to the automatic screw tightening control method described in claim 8 of the present invention, by determining a matching state with the target load current value (including the permissible range) set in advance, if an operator unintentionally mis-operates an adjustment mechanism capable of external operation of torque setting for operating the clutch mechanism, for example, the target load current value is mis-set, and the detected value of the load current value in the electric motor at the clutch operation time does not match the target load current value (including the permissible range) in initial setting, whereby it can be easily determined to be defective screw tightening. Therefore, in this case, by reconfirming and resetting the torque setting of the mis-operated clutch mechanism, the subsequent appropriate screw tightening operation can be easily realized, and occurrence of a defect rate in the screw tightening operation can be reduced.

According to the automatic screw tightening control method described in claim 9 of the present invention, together with the acceptability determination of the screw tightened state described, respectively, if the rotation amount of the electric motor is smaller than the target rotation amount (including the permissible range), for example, it is determined to be an abnormal state such as galling of a screw, screw lifting, unmatched selected screw dimension and the like, while if the rotation amount of the electric motor is larger than the target rotation amount (including the permissible range), it can be determined to be an abnormal state such as loss of the screw grip, abrasion of a prepared hole, come-out of the screw, bit damage, unmatched selected screw dimension and the like, and determination of defective screw tightening can be easily made, respectively. Therefore, according to the present invention, together with above-described reduction of the defect rate in the screw tightening operation, detection and continuation of human and physical operation errors can be also made easily.

According to the automatic screw tightening control method and the device described in claims 10 and 18 of the present invention, since the acceptability determination of the screw tightened state can be made extremely easily and accurately as described above, the number of screws particularly determined that the screw tightened state is appropriate can be reliably recorded in the control portion distinctively from the number of screws determined to be abnormal or defective, and by confirming or displaying the numbers of the screws recorded as above, efficiency of the screw tightening operation and its reliability can be improved. Moreover, similarly to the above, the length dimension of the screw used for the screw tightening can be recorded in the control portion accurately, and moreover, the recorded contents can be displayed on the basis of the rotation amount detected at the clutch operation time when the screw tightened state is determined to be appropriate.

According to the automatic screw tightening control method and the device described in claims 11 and 19 of the present invention, by displaying the above-described acceptability determination of the screw tightened state on the display, appropriate screw tightening operations and improvement of efficiency can be realized, and enlargement of the function as the electric driver can be achieved.

According to the automatic screw tightening control method described in claim 12 of the present invention, if the clutch operation of the clutch mechanism is detected by the clutch operation detection sensor in the above-described configuration of the electric driver and/or if the time when the target load current value is reached, associated with completion of screw tightening set in advance, is detected by the load current detecting means, by detecting the rotation amount of the electric motor sequentially detected by the rotation amount detecting means and by comparing the target load current value (including the permissible range) associated with completion of the screw tightening and the target rotation amount (including the permissible range) set in advance as the rotation amount of the electric motor, acceptability of the screw tightened state can be easily and simply determined similarly to the above, and the appropriate screw tightened state in the screw tightening operation can be confirmed and determined reliably.

BRIEF DESCRIPTION OF THE DRAWINGS

FIG. 7 are explanatory diagrams illustrating the relation of screw tightening acceptability determination similar to the case illustrated in FIG. 5, in which

FIG. 8 are explanatory diagrams illustrating the relation of screw tightening acceptability determination similar to the case illustrated in FIG. 6, in which

EMBODIMENTS FOR CARRYING OUT THE INVENTION

Subsequently, an embodiment of an automatic screw tightening control method according to the present invention will be described below in detail by referring to the attached drawings in a relation with a device for performing this method.

[Configuration of Automatic Screw Tightening Control Device (1)]

Figure 1:
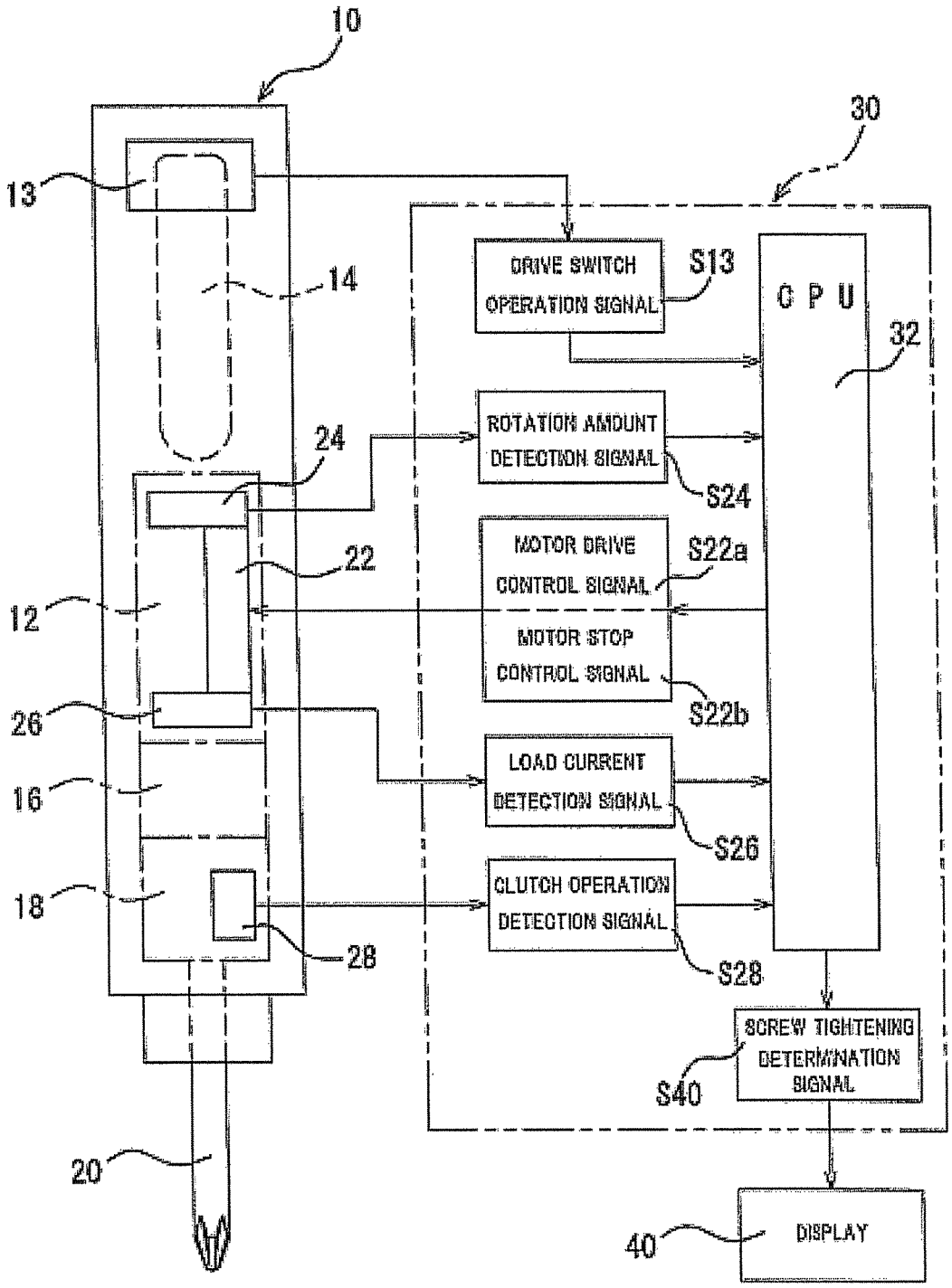
FIG. 1 is an explanatory diagram illustrating a schematic configuration illustrating an embodiment of a device performing an automatic screw tightening control method according to the present invention and its control system.

FIG. 1 is a schematic configuration explanatory diagram illustrating an embodiment of a device for performing the automatic screw tightening control method according to the present invention. That is, in FIG. 1, reference numeral 10 denotes an electric driver, and in a gripping portion of this electric driver 10, an electric motor 12, a drive switch 13 for driving this electric motor 12, a reduction gear mechanism 16 and a clutch mechanism 18 coupled to a drive output shaft (not shown) of the electric motor 12 are incorporated, respectively, and the electric driver is configured to have a driver bit 20 coupled through the clutch mechanism 18.

In the electric driver 10, a switch operating member 14 for operating the drive switch 13 of the electric motor 12, an electric motor control circuit 22 for executing drive control and stop control of the electric motor 12, and a clutch operation detection sensor 28 for detecting a clutch operation of the clutch mechanism 18 are provided, respectively. In the electric motor control circuit 22, rotation amount detecting means 24 for detecting a rotation amount of the electric motor 12 is provided. Moreover, load current detecting means 26 for detecting a load current obtained in the electric motor 12 on the basis of a load torque (reaction force) imparted to the driver bit 20 is provided as appropriate.

In the electric driver 10 in this embodiment, a brushless motor can be suitably used as the electric motor 12. Moreover, as the switch operating member 14 for operating the drive switch 13 in order to drive the electric motor 12, it can be constituted as a known lever member provided in an outer periphery of the gripping portion of the electric driver 10, for example.

Moreover in this embodiment, the rotation amount detecting means 24 for detecting a rotation amount of the electric motor 12 can be provided as means for counting a pulse generated when a magnetic pole is detected on a Hall element for detecting the magnetic pole of a rotor in the brushless motor. In this case, the number of counts of the pulses detected by the rotation amount detecting means 24 can be detected/recorded as a rotation amount correlating a screw tightening rotation amount in a screw tightening operation involved in rotation of the driver bit 20.

Moreover, the load current detecting means 26 for detecting a load current of the electric motor 12 can be provided as means for detecting a load current in a power supply circuit of the electric motor 12. In this case, a detected load current value of the electric motor 12 can be detected/recorded as a load current value correlating a screw tightening torque value in the screw tightening operation involved in the rotation of the driver bit 20.

As the clutch mechanism 18, it is configured such that a clutch plate is mounted on an output shaft of the reduction gear mechanism 16, for example, and a clutch ball is elastically engaged in an axial direction with this clutch plate, and in the screw tightening operation, when a load torque (reaction force) of a certain level or more is applied to the output shaft via the driver bit 20, the clutch plate rides over the clutch ball, and transmission of a rotation driving force to a bit holder for engaging and holding the driver bit 20 is shut off so that the screw can be tightened by a torque set in advance. In this case, when the clutch ball is elastically engaged with the clutch plate, a screw tightening torque can be set by adjusting the elasticity as appropriate.

As the clutch operation detection sensor 28 for detecting the clutch operation of the clutch mechanism 18, known means such as a limit switch operated by displacement of the clutch plate at the clutch operation time, a magnetic sensor for detecting rotation of an internal gear constituting the reduction gear mechanism 16 idling at the clutch operation time and the like can be used for constitution.

Thus, in this embodiment, a control portion 30 is provided, and it is configured such that, in a CPU 32, when the screw tightening operation is started, a drive switch operation signal S13 obtained by an operation of the drive switch 13 operated by the switch operating member 14 is inputted into the electric motor control circuit 22 provided in the electric motor 12 in the electric driver 10, and on the basis of this drive switch operation signal S13, a motor drive control signal S22*a* is outputted and inputted into the electric motor control circuit 22 so as to execute drive control of the electric motor 12.

When a required screw tightening operation is to be performed by driving of the electric motor 12, in the CPU 32, at drive start time t0 of the electric motor 12 associated with start of the screw tightening operation, it is set that a rotation amount Rt of the electric motor 12 is detected/recorded on the basis of a rotation amount detection signal S24 detected by the rotation amount detecting means 24.

Moreover, similarly to the above, at the drive start time t0 of the electric motor 12 associated with start of the screw tightening operation, it is set that a load current value It in proportion with a screw tightening torque value is detected/ recorded on the basis of a load current detection signal S26 detected by the load current detecting means 26.

Then, in the CPU 32, at clutch operation time t1 obtained on the basis of a clutch operation detection signal S28 detected by the clutch operation detection sensor 28 at the clutch operation time of the clutch mechanism 18, it is set that a rotation amount of the electric motor 12 is detected, and setting of a target rotation amount Rm±α (±α is a permissible range) which will be described later and a rotation amount Rt1 to be compared with this target rotation amount Rm±α are detected/recorded, respectively.

Moreover, similarly to the above, it is set that at the clutch operation time t1 obtained on the basis of a clutch operation detection signal S28 detected by the clutch operation detection sensor 28 at the clutch operation time of the clutch mechanism 18, a load current value in proportion with the screw tightening torque value is detected, and setting of a target load current value Im±β (±β is a permissible range) which will be described later and the load current value It1 to be compared with this target load current value Im±β are detected/recorded, respectively.

Moreover, as described above, when the clutch operation is detected by the clutch operation detection sensor 28, it is configured such that a motor stop control signal S22*b* is outputted and inputted into the electric motor control circuit 22 via the CPU 32 so as to execute stop control of the electric motor 12.

Moreover, in this embodiment, as described above, in the CPU 32 of the control portion 30, if acceptability of the screw tightened state is determined by comparing the rotation amount Rt1 detected at the clutch operation time t1 with the target rotation amount Rm±α set in advance, and/or if acceptability of the screw tightened state is determined by comparing the current load value It1 detected at the clutch operation time t1 with the target load current value Im±β set in advance, it is configured such that the respective determination contents are displayed on the display 40 as appropriate by either one of screw tightening determination signals S40 outputted from the CPU 32.

Subsequently, as the automatic screw tightening control method (1) to (3) by the automatic screw tightening control device configured as above, the respective acceptability determination of the screw tightened state will be described by referring to their control flowcharts (see FIGS. 2 to 4) and characteristics of the rotation amount and characteristics of the load current value (see FIGS. 5 to 10) of the electric motor 12 at the clutch operation time.

[Automatic Screw Tightening Control Method (1)]

Figure 2:
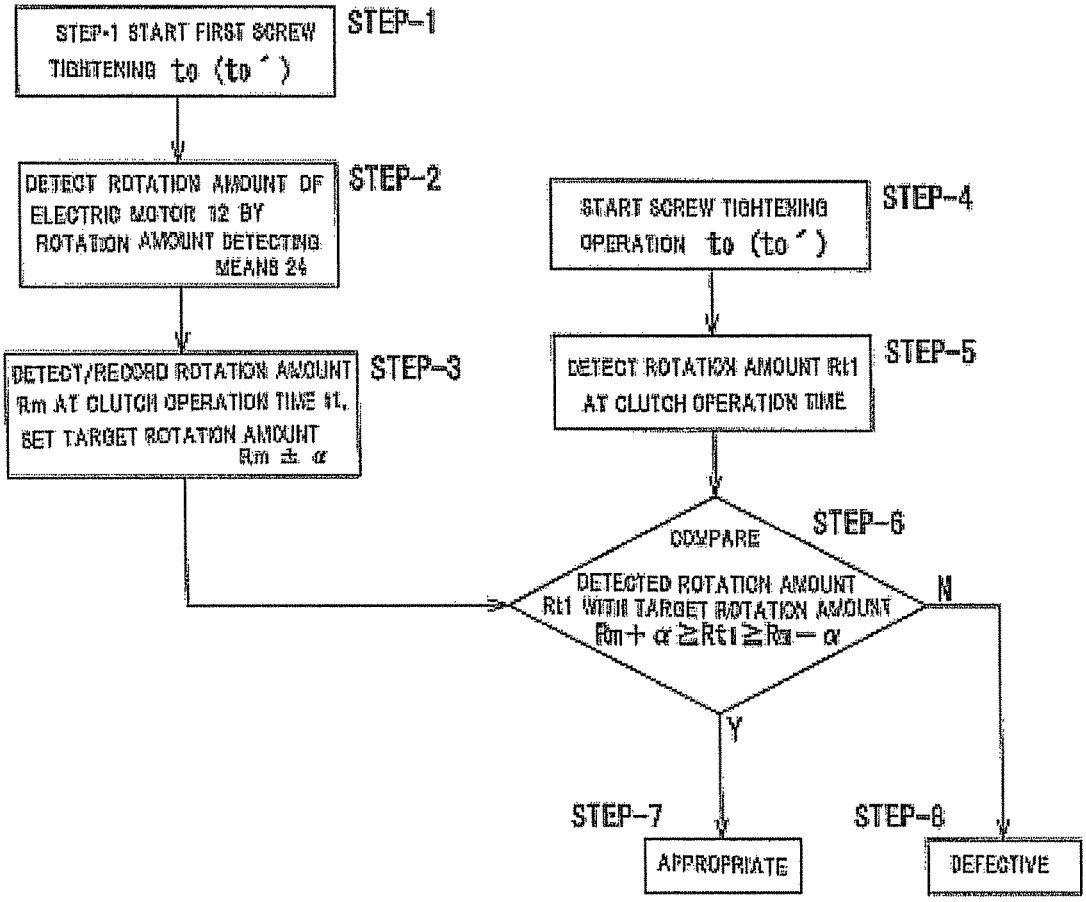
FIG. 2 is a flowchart illustrating a screw tightening control program by a first control method for making acceptability determination of screw tightening by an automatic screw tightening control device illustrated in FIG. 1.

In this control method (1), at start of the required screw tightening operation, the drive switch 13 is operated by operating the switch operating member 14, the motor drive control signal S22*a* is inputted into the electric motor control circuit 22 so as to execute drive control of the electric motor 12, and drive of the electric driver 10 is started (see FIGS. 1 and 2).

At start of the screw tightening operation involved in drive of the electric driver 10 as above, the rotation amount Rt of the electric motor 12 is set to be detected/recorded with the electric motor drive start time t0 in the CPU 32 on the basis of the rotation amount detection signal S24 detected in advance by the rotation amount detecting means 24 (STEP-1, STEP-2).

Thus, in this control method (1), in a predetermined screw tightening operation by the electric driver 10, by performing the predetermined screw tightening operation in advance, the rotation amount Rm of the electric motor 12 from the screw-tightening start time t0 (STEP-1) to the clutch operation time t1 by the clutch mechanism 18 associated with completion of the screw tightening is detected by the rotation amount detecting means 24 (STEP-2) and recorded in the CPU 32 of the controller 30 and set in the CPU 32 as the target rotation amount Rm±α (±α is the permissible range) (STEP-3).

Then, in the subsequent predetermined screw tightening operations (second session and after), it is set that the rotation amount Rt of the electric motor 12 from the screw-tightening start time t0 (STEP-4) to the clutch operation time t1 by the clutch mechanism 18 associated with completion of the screw tightening is sequentially detected by the rotation amount detecting means 24 by the rotation amount detecting means 24 (STEP-5), and the rotation amount Rt1 detected at the clutch operation time t1 is compared with the target rotation amount Rm±α (including the permissible range) (STEP-6) so that acceptability of the screw tightened state is determined.

At start of the screw tightening operation associated with drive of the electric driver 10 (STEP-1 and STEP-4), when the rotation amount Rt of the electric motor 12 is detected/recorded in the CPU 32 on the basis of the rotation amount detection signal S24 detected by the rotation amount detecting means 24, by detecting the rotation amount Rt of the electric motor 12 while the screw tightening operation is actually performed since the driver bit 20 was brought into contact with a screw mounting target, an accurate rotation amount can be detected.

Thus, in this control method (1), as the applicant proposed in Japanese Patent No. 4721535, in the electric driver 10, a push-operation switch (not shown) operated by displacement in the axial direction at contact of the driver bit 20 with the screw mounting target is provided so that screw tightening start time t0' when the screw tightening operation is performed can be set by an operation signal of this push-operation switch.

That is, as the push-operation switch, it can be configured such that a support shaft supporting the driver bit 20 is coupled by a shaft joint, capable of elastic displacement in the axial direction, a magnet is provided in a displacement portion of this support shaft, and a magnetic sensor (Hall element) is arranged on an outer periphery portion of the support shaft so as to face this magnet.

In this control method (1), when the rotation amount Rt1 of the electric motor 12 sequentially detected from the screw tightening start time t0 to the clutch operation time t1 by the predetermined screw tightening operation is compared with the target rotation amount Rm±α (including the permissible range) (STEP-6), it can be configured such that the rotation amount Rt1 of the electric motor detected from the set value of the target rotation amount Rm±α to the clutch operation time t1 in the predetermined screw tightening operation is calculated to be sequentially added, and the final detected value of the rotation amount Rt1 is compared with a set value of the target rotation amount Rm±α (including the permissible range).

Moreover, when the rotation amount Rt1 of the electric motor 12 sequentially detected from the screw tightening start time t0 to the clutch operation time t1 by the predetermined screw tightening operation is compared with the first target rotation amount Rm±α (including the permissible range) (STEP-6), it can be also configured such that the rotation amount of the electric motor 12 detected from the set value of the first target rotation amount Rm±α to the clutch operation time t1 in the predetermined screw tightening operation is calculated to be sequentially subtracted and set so as to finally become a second target rotation amount 0±α (including the permissible range), and the final detected value of the rotation amount Rt1 is compared with a set value of the second target rotation amount 0±α (including the permissible range).

As described above, when the target rotation amount Rm±α or 0±α (including the permissible range) is set and the predetermined screw tightening operation is performed, if the clutch operation is detected in the clutch mechanism 18, the clutch operation time t1 is detected/recorded in the CPU 32, and the rotation amount Rt1 of the electric motor 12 at this clutch operation time t1 is detected/recorded (STEP-5). Then, the rotation amount Rt1 of the electric motor 12 detected at the clutch operation time t1 is compared with the target rotation amount Rm±α or 0±α set in advance, and it is determined whether or not it matches the target rotation amount Rm±α or 0±α (Rm+α≥Rt1≥Rm−α or 0+α≥Rt1≥0−α) (STEP-6).

Moreover, as described above, by setting the screw-tightening start time t0' for detecting the rotation amount Rt of the electric motor 12 while the screw tightening operation is actually performed since the driver bit 20 is brought into contact with the screw mounting target and by comparing the rotation amount Rt1 of the electric motor 12 detected/recorded in the CPU 32 with the target rotation amount Rm±α or 0±α set in advance, if the rotation amount Rt1 matches the target rotation amount Rm±α or 0±α (including the permissible range), respectively (see FIGS. 5 and 6), it can be determined to be an appropriate screw tightened state (STEP-7). Moreover, if the rotation amount Rt1 of the electric motor 12 detected/recorded in the CPU 32 does not match the target rotation amount Rm±α or 0±α (including the permissible range), it can be determined that the screw tightened state is defective (STEP-8).

In this case, it can be determined to be an appropriate screw tightened state when the rotation amount Rt1 of the electric motor 12 detected/recorded in the CPU 32 reaches 60 to 70% of the target rotation amount set in advance. Moreover, it can be similarly determined to be the appropriate screw tightened state when 80% or more is reached.

Therefore, in this case, the number of screws determined that the screw tightened state is appropriate can be accurately recorded in the control portion 30, and it can be set such that the recorded contents are displayed on the display 40. Moreover, the length dimension of the screw which performed screw tightening can be also accurately recorded in the control portion 30 on the basis of the rotation amount Rt1 of the electric motor 12 detected at the clutch operation time t1, and moreover, it can be set such that the recorded contents are displayed on the display 40.

Figure 7A:
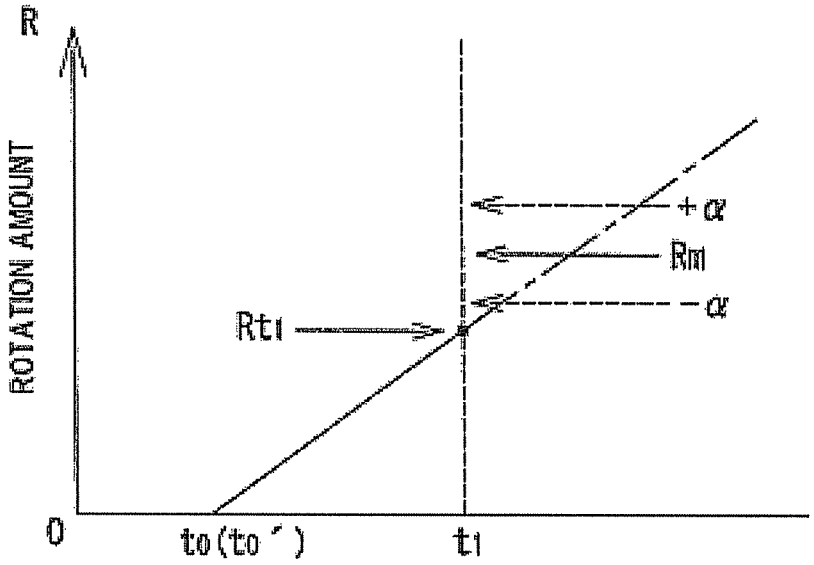
FIG. 7*a* is an explanatory diagram illustrating a defective screw tightened state when the rotation amount is smaller than the target rotation amount Rm±α (including a permissible range)
Figure 7B:
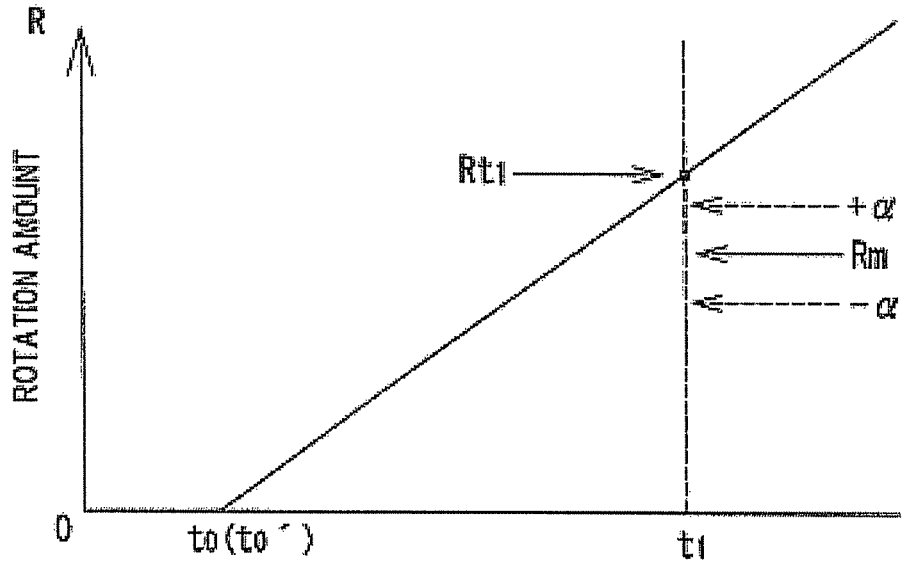
FIG. 7*b* is an explanatory diagram illustrating a defective screw tightened state when the rotation amount is larger than the target rotation amount Rm±α (including the permissible range).
Figure 8A:
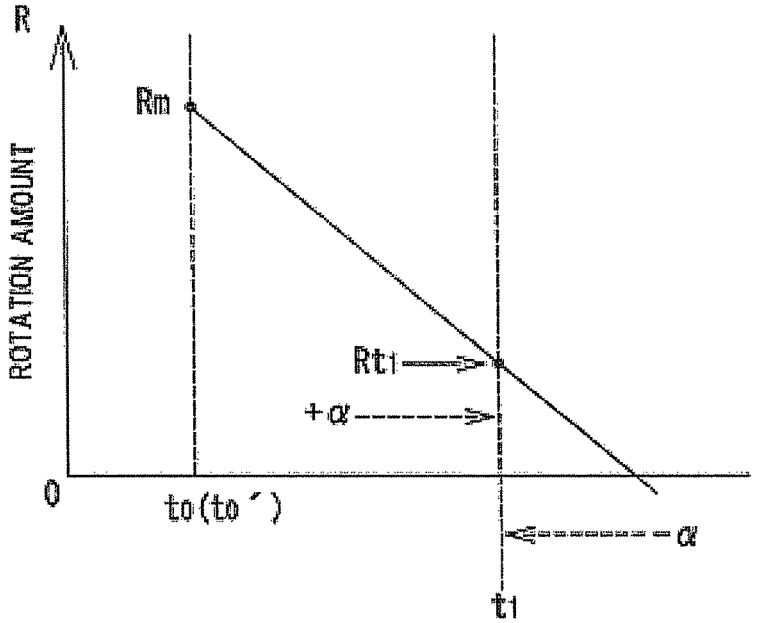
FIG. 8*a* is an explanatory diagram illustrating a defective screw tightened state when the rotation amount is larger than the target rotation amount 0±α (including the permissible range)
Figure 8B:
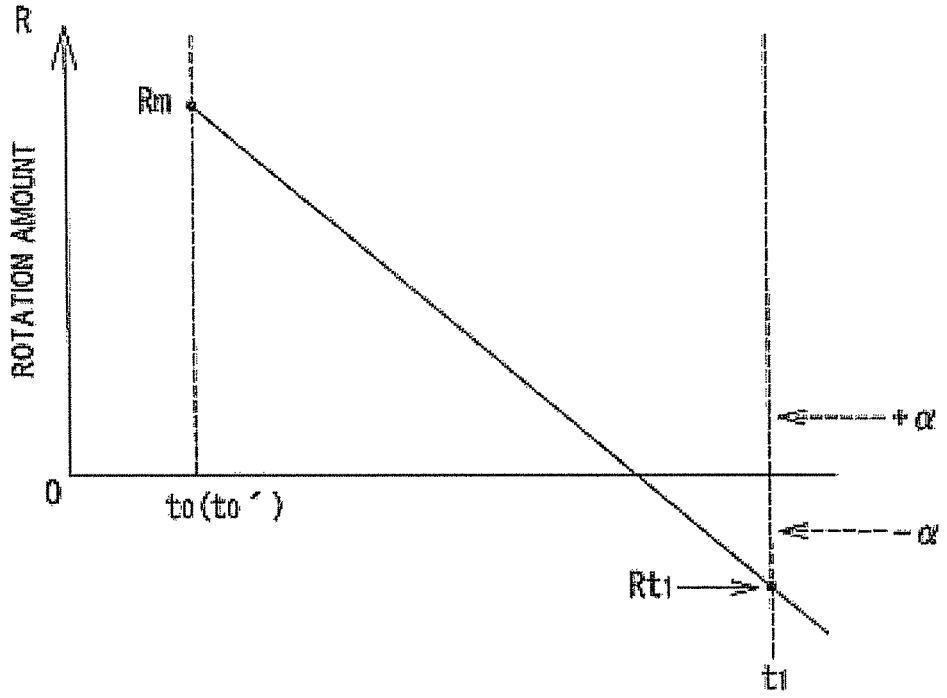
FIG. 8*b* is an explanatory diagram illustrating a defective screw tightened state when the rotation amount is smaller than the target rotation amount 0±α (including the permissible range).
Figure 9:
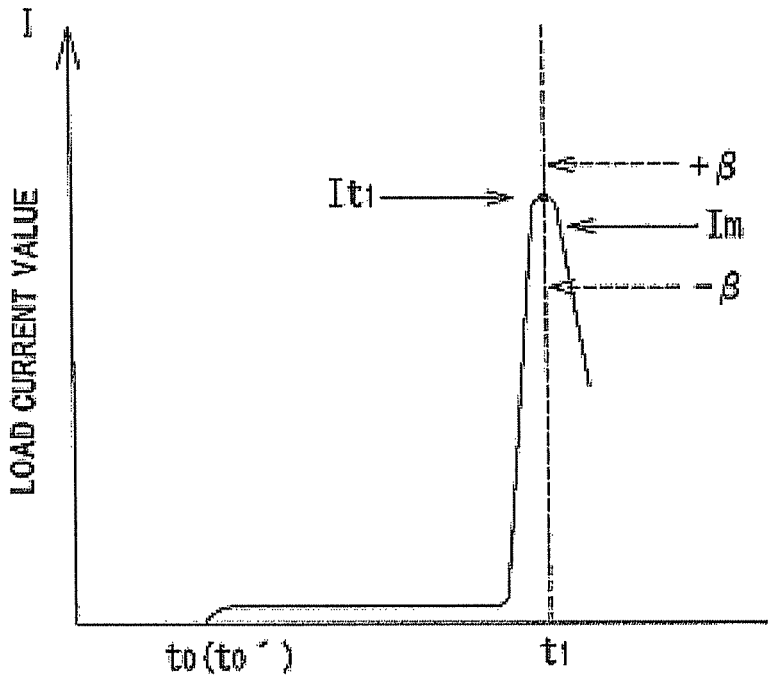
FIG. 9 is an explanatory diagram illustrating an appropriate screw tightened state in the relation of screw tightening acceptability determination by detected value characteristics of a load current value in the electric motor at the clutch operation time by the automatic screw tightening control method according to the present invention illustrated in FIGS. 3 and 4.
Figure 10:
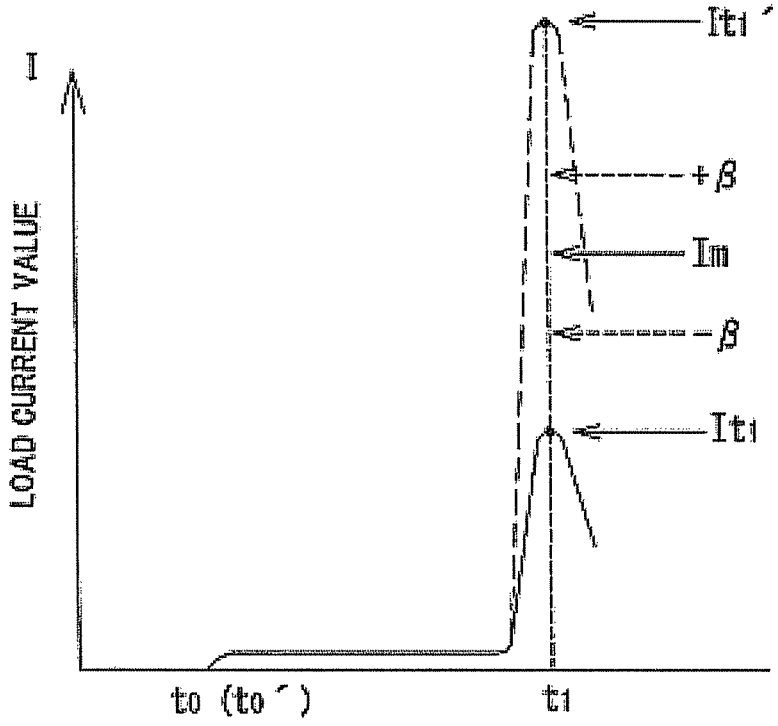
FIG. 10 is an explanatory diagram illustrating a defective screw tightened state of the load current value in the relation of screw tightening acceptability determination similar to the case illustrated in FIG. 9.

Moreover, if the rotation amount Rt1 of the electric motor 12 detected/recorded in the CPU 32 is smaller than the target rotation amount Rm±α (Rt1<Rm−α) or larger than the target rotation amount 0±α (Rt1>0+α), it can be detected as an abnormal state such as galling of a screw, screw lifting, unmatched selected screw dimension and the like generated in the screw tightened state (see FIG. 7*a* and FIG. 8*a*). Moreover, if the rotation amount Rt1 is larger than the target rotation amount Rm±α (Rt1>Rm+α) or smaller than the target rotation amount Rm±α (Rt1<0−α), it can be detected to be an abnormal state such as loss of the screw grip, abrasion of a prepared hole, come-out of the screw, bit damage, unmatched selected screw dimension and the like generated in the screw tightened state (see FIG. 7*b* and FIG. 8*b*).

When acceptability of the screw tightened state is determined as described above, determination can be displayed so that determination to be appropriate and determination to be defective can be clearly distinguished. Thus, in this control method, it can be so configured that the respective determination contents are displayed on the display 40 as appropriate by either of the screw tightening determination signal S40 outputted from the CPU 32 (see FIG. 1).

[Automatic Screw Tightening Control Method (2)]

Figure 3:
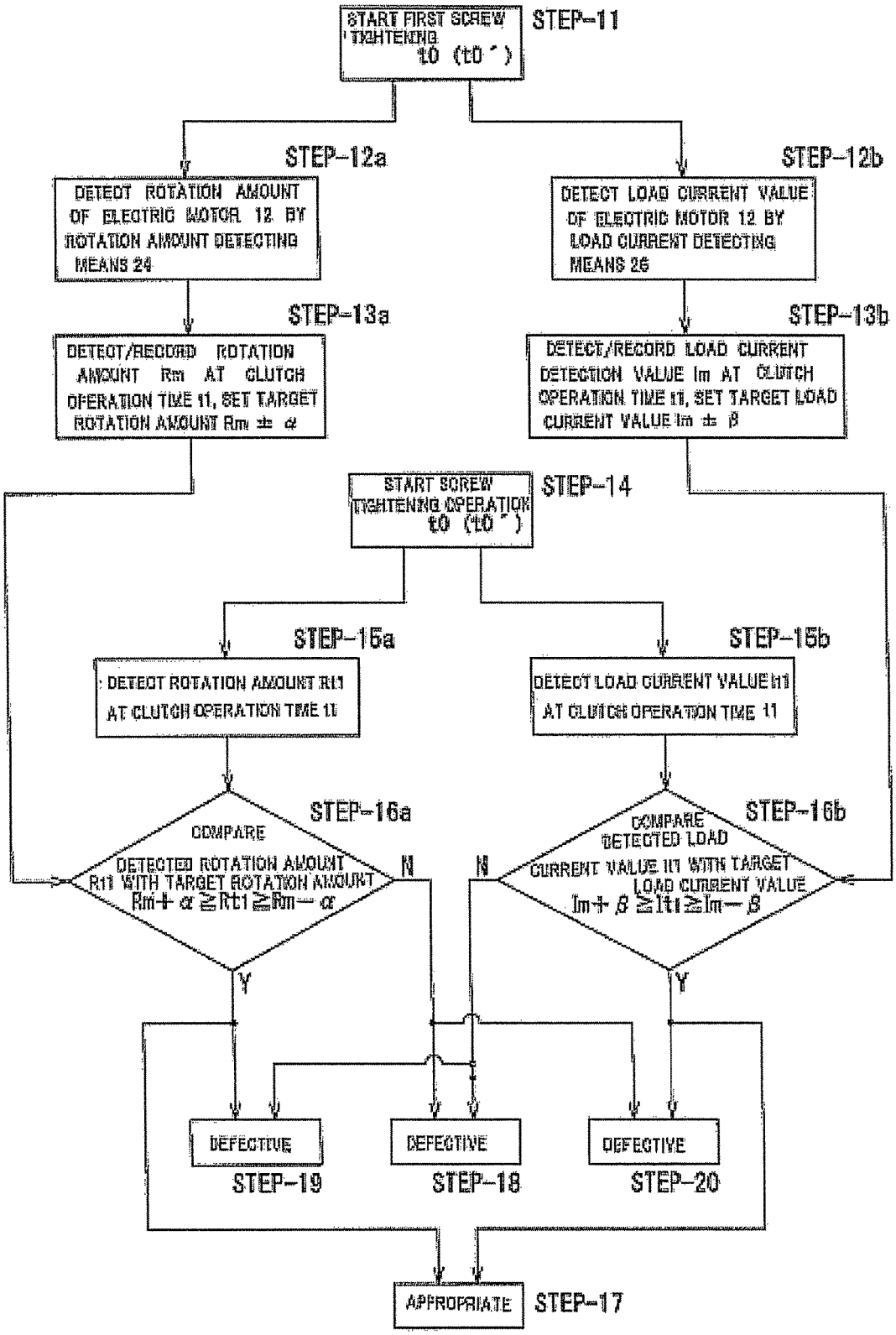
FIG. 3 is a flowchart illustrating a screw tightening control program by a second control method for making acceptability determination of screw tightening by the automatic screw tightening control device illustrated in FIG. 1.

In this control method (2), similarly to the above-described control method (1), at start of the screw tightening operation associated with drive of the electric driver 10, the rotation amount Rt of the electric motor 12 is detected/recorded with the electric motor drive start time t0 in the CPU 32 on the basis of the rotation amount detection signal S24 detected by the rotation amount detecting means 24 in advance (STEP-11, STEP-12*a*) and moreover, the load current value It in proportion with the screw tightening torque value detected by the load current detecting means 26 is set to be detected/recorded with the screw tightening start time t0 in the CPU 32 (STEP-11, STEP-12*b*) (see FIGS. 1 and 3).

Thus, in this control method (2), similarly to the above-described control method (1), when the required screw tightening operation is performed by the electric driver 10, by performing the predetermined screw tightening operation in advance, the rotation amount Rm of the electric motor 12 from the screw-tightening start time t0 (STEP-11) to the clutch operation time t1 by the clutch mechanism 18 associated with completion of the screw tightening is detected by the rotation amount detecting means 24 (STEP-12*a*) and recorded in the CPU 32 of the controller 30 and set in the CPU 32 as the target rotation amount Rm±α (±α is a permissible range) (STEP-13*a*). Moreover, the load current value Im of the electric motor 12 from the screw-tightening start time t0 to the clutch operation time t1 by the clutch mechanism 18 associated with completion of the screw tightening is detected by the load current detecting means 26 (STEP-12*b*) and recorded in the CPU 32 of the controller 30 and set in the CPU 32 as the target load current value Im±β (±β is a permissible range) (STEP-13*b*).

Then, in the subsequent predetermined screw tightening operations (second session and after), similarly to the above-described control method, it is set that the rotation amount Rt of the electric motor 12 from the screw-tightening start time t0 (STEP-14) to the clutch operation time t1 by the clutch mechanism 18 associated with completion of the screw tightening is sequentially detected by the rotation amount detecting means 24 (STEP-15*a*), and the rotation amount Rt1 detected at the clutch operation time t1 is compared with the target rotation amount Rm±α (including the permissible range) (STEP-16*a*) so that acceptability of the screw tightened state is determined. Moreover, it is set that the load current value It from the screw-tightening start time t0 to the clutch operation time t1 by the clutch mechanism 18 associated with completion of the screw lightening is sequentially detected by the load current detecting means 26 (STEP-15*b*), and the load current value It1 detected at the clutch operation time t1 is compared with the target load current value Im±β (including the permissible range) (STEP-16*b*) so that acceptability of the screw tightened state is determined.

Then, the rotation amount Rt1 of the electric motor 12 detected at the clutch operation time t1 is compared with the target rotation amount Rm±α set in advance, and it is determined whether or not it matches the target rotation amount Rm±α (Rm+α≥Rt1≥Rm−α) (STEP-16*a*). Moreover, the load current value It1 detected at the clutch operation time t1 is compared with the target load current value Im±β, set in advance and it is determined whether or not it matches the target load current value Im±β (Im+

$\beta \geq It1 \geq Im-\beta$) (STEP-16*b*). In this case, as means for comparing the rotation amount Rt1 of the electric motor 12 with the target rotation amount $Rm \pm \alpha$ and for determining whether or not it matches the target rotation amount $Rm \pm \alpha$ ($Rm+\alpha \geq Rt1 \geq Rm-\alpha$), all the above-described control methods (1) can be applied.

At the above-described clutch operation time t1, if the rotation amount Rt1 and the load current value It1 of the electric motor 12 detected/recorded, respectively, satisfy the respective conditions (see FIG. 5 or FIGS. 6 and 9), it can be determined that the screw tightened state is appropriate (STEP-17). Therefore, in this case, in the control portion 30, the number of screws determined that the screw tightened state is appropriate can be accurately recorded and it can be set that the recorded contents are displayed on the display 40. Moreover, the length dimension of the screw performing the screw tightening can be accurately recorded in the control portion 30 on the basis of the rotation amount Rt1 of the electric motor 12 detected at the clutch operation time t1 and moreover, it can be set that the recorded contents are displayed on the display 40.

On the other hand, if the adjustment mechanism performing torque setting of the clutch mechanism 18 is misoperated and the target load current value Im is lowered or increased, for example, at the clutch operation time t1, the detected/recorded load current value It1 does not match the target load current value $Im \pm \beta$ including the permissible range ($It1 < Im \pm \beta < It1'$) (see FIG. 10), and in such a case, even if the detected/recorded rotation amount Rt1 of the electric motor 12 matches the target rotation amount $Rm \pm \alpha$ ($Rm+\alpha \geq Rt1 \geq Rm-\alpha$) (see FIG. 5), it can be determined that the screw tightened state is defective (STEP-19).

Moreover, even if the detected/recorded load current value It1 matches the target load current value $Im \pm \beta$ at the clutch operation time t1 ($Im+\beta \geq It1 \geq Im-\beta$) (see FIG. 9), if the detected/recorded rotation amount Rt1 of the electric motor 12 is smaller than the target rotation amount $Rm \pm \alpha$ ($Rt1 < Rm-\alpha$) (see FIG. 7*a* and FIG. 8*a*), it can be determined that the screw tightened state is defective (STEP-20).

Furthermore, at the clutch operation time t1 (including the case in which the clutch operation is not confirmed), even if the detected/recorded rotation amount Rt1 of the electric motor 12 is larger than the target rotation amount $Rm \pm \alpha$ ($Rt1 > Rm+\alpha$) (see FIG. 7*b* and FIG. 8*b*), it can be determined similarly to the above that the screw tightened state is defective (STEP-20).

At the above-described clutch operation time t1, if the detected/recorded load current value It1 does not match the target load current value $Im \pm \beta$ ($It1 < Im \pm \beta < It1$) and moreover, if the detected/recorded rotation amount Rt1 of the electric motor 12 does not match the target rotation amount $Rm \pm \alpha$ ($Rt1 < Rm \pm \alpha < Rt1$), it can be naturally determined that the screw tightened state is defective (STEP-18).

Therefore, in this control method (2), too, similarly to the above-described control method (1), if acceptability of the screw tightened state is determined, determination can be displayed so that determination to be appropriate and determination to be defective can be clearly distinguished. Thus, in this control method, it can be so configured that, by either of the above-described screw tightening determination signal S40 outputted from the CPU 32, the respective determination contents are displayed on the display 40 as appropriate (see FIG. 1).

[Automatic Screw Tightening Control Method (3)]

Figure 4:
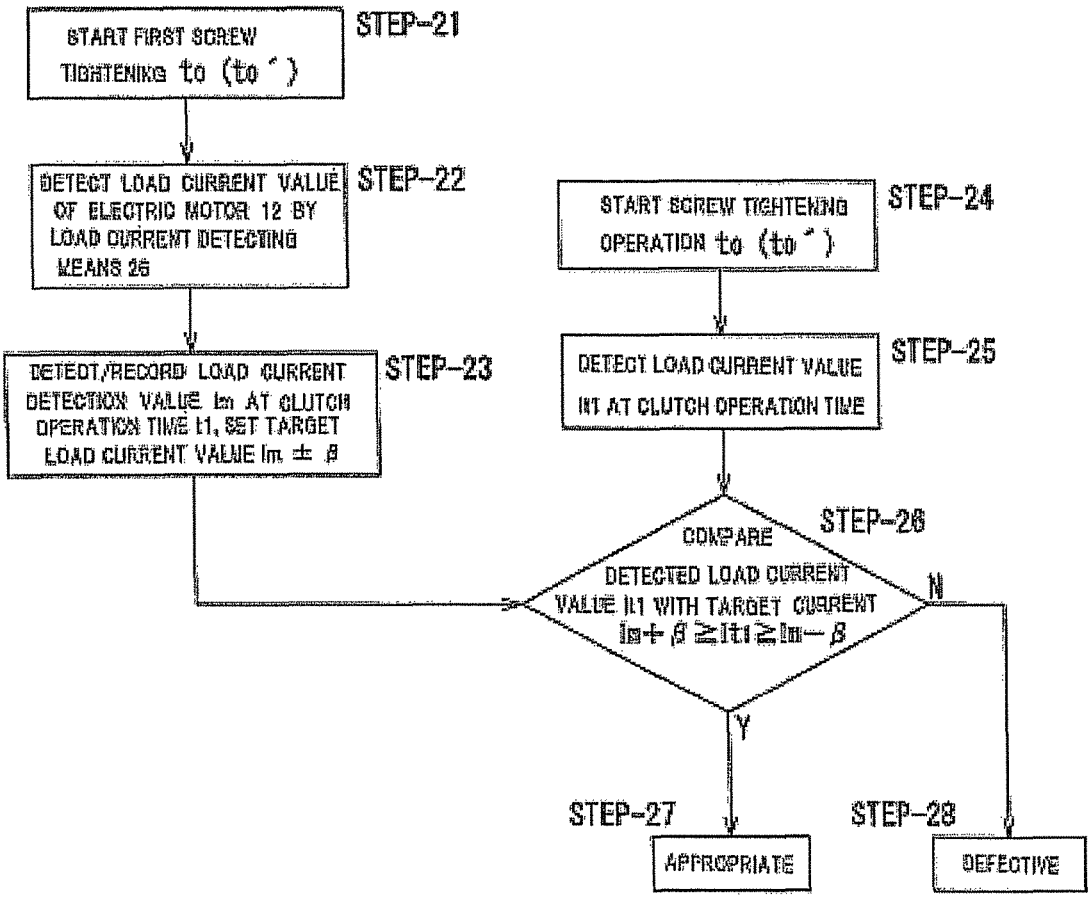
FIG. 4 is a flowchart illustrating a screw tightening control program by a third control method for making acceptability determination of screw tightening by the automatic screw tightening control device illustrated in FIG. 1.
Figure 5:
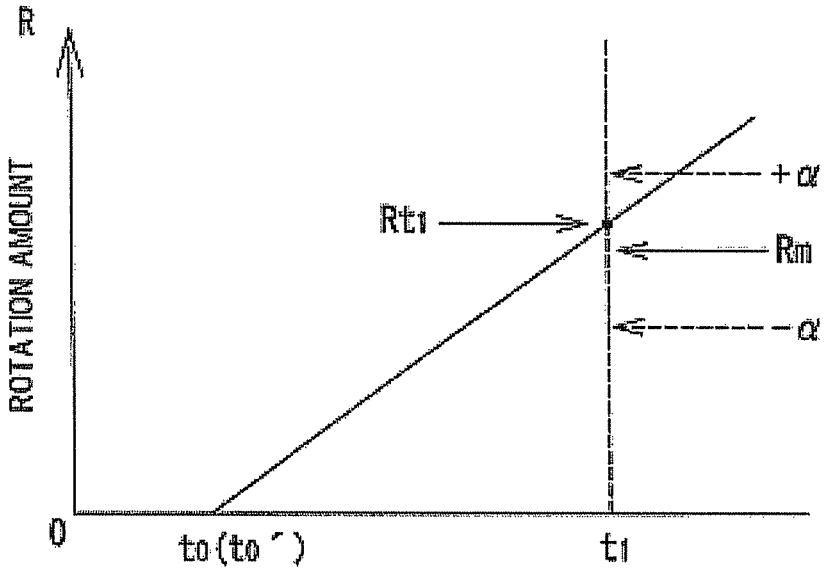
FIG. 5 is an explanatory diagram illustrating an appropriate screw tightened state when a target rotation amount is set to $Rm \pm \alpha$ in a relation of screw tightening acceptability determination by detected value characteristics of a rotation amount in an electric motor at clutch operation time by the automatic screw tightening control method according to the present invention illustrated in FIGS. 2 and 3.
Figure 6:
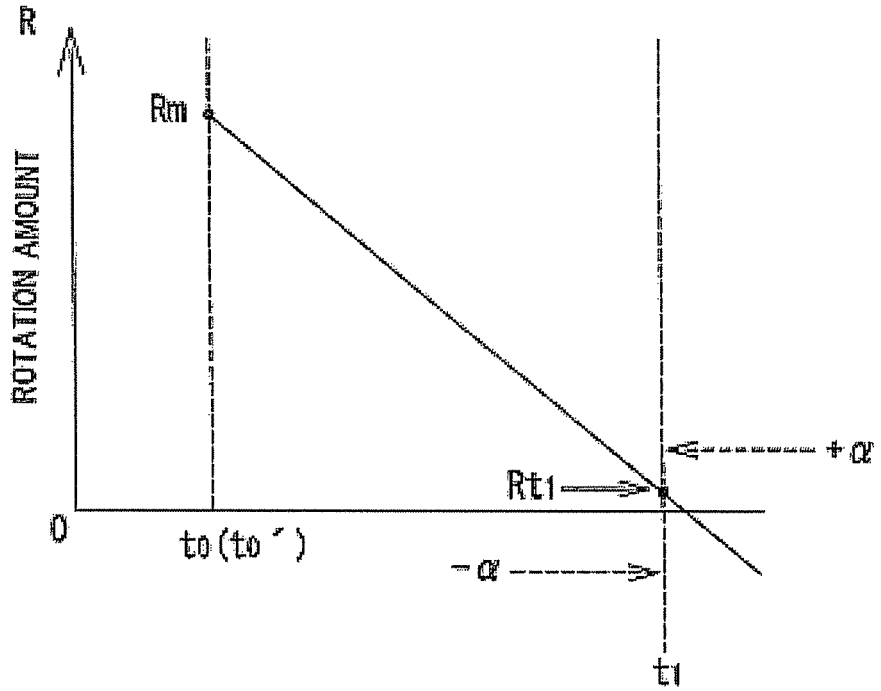
FIG. 6 is an explanatory diagram illustrating the appropriate screw tightened state when the target rotation amount is set to $0 \pm \alpha$ in the relation of screw tightening acceptability determination by detected value characteristics of the rotation amount in the electric motor at clutch operation time by the automatic screw tightening control method according to the present invention illustrated in FIGS. 2 and 3.

In this control method (3), the rotation amount detecting means 24 is not provided, and at start of the screw tightening operation associated with drive of the electric driver 10, the load current value It in proportion with the screw tightening torque value detected by the load current detecting means 26 in advance is set to be detected/recorded with the screw-tightening start timing t0 in the CPU 32 (STEP-21, STEP-22) (see FIGS. 1 and 4).

Thus, in this control method (3), when the required screw tightening operation is performed by the electric driver 10, by performing the predetermined screw tightening operation in advance, the load current value Im of the electric motor 12 from the screw-tightening start time t0 (STEP-21) to the clutch operation time t1 by the clutch mechanism 18 associated with completion of the screw tightening is detected by the load current detecting means 26 (STEP-22) and recorded in the CPU 32 of the controller 30, and set in the CPU 32 as the target load current value $Im \pm \beta$ ($\pm\beta$ is a permissible range) (STEP-23).

Then, in the subsequent predetermined screw tightening operations (second session and after), similarly to the above-described control method (1), it is set that the load current value It of the electric motor 12 from the screw-tightening start time t0 (STEP-24) to the clutch operation time t1 by the clutch mechanism 18 associated with completion of the screw tightening is sequentially detected by the load current detecting means 26 (STEP-25), and the load current value It1 detected at the clutch operation time t1 is compared with the target load current value $Im \pm \beta$ (including the permissible range) (STEP-26) so that acceptability of the screw tightened state is determined.

Thus, by comparing the load current value It1 of the electric motor 12 detected at the clutch operation time t1 with the target load current value $Im \pm \beta$ set in advance, it is determined whether or not it matches the target load current value $Im \pm \beta$ ($Im+\beta \geq It1 \geq Im-\beta$) (STEP-26).

At the above-described clutch operation time t1, if the load current value It1 and the rotation amount Rt1 of the electric motor 12 detected/recorded, respectively, satisfy the respective conditions (see FIGS. 9 and 5 or FIG. 6), it can be determined that the screw tightened state is appropriate (STEP-27). Therefore, in this case, in the control portion 30, the number of screws determined that the screw tightened state is appropriate can be accurately recorded and it can be set that the recorded contents are displayed on the display 40. Moreover, the length dimension of the screw performing the screw tightening can be accurately recorded in the control portion 30 on the basis of the rotation amount Rt1 of the electric motor 12 detected at the clutch operation time t1 and moreover, it can be set that the recorded contents are displayed on the display 40.

On the other hand, if the adjustment mechanism performing torque setting of the clutch mechanism 18 is misoperated and the target load current value Im is lowered or increased, for example, at the clutch operation time t1, the detected/recorded load current value It1 does not match the target load current value $Im \pm \beta$ including the permissible range ($It1 < Im \pm \beta < It1'$) (see FIG. 10), and it can be determined that the screw tightened state is defective (STEP-28).

Therefore, in this control method (3), too, if acceptability of the screw tightened state is determined similarly to the above-described control methods (1) and (2), determination can be displayed so that determination to be appropriate and determination to be defective can be clearly distinguished. Thus, in this control method, it can be so configured that the respective determination contents are displayed on the display 40 as appropriate by either of the screw tightening determination signal S40 outputted from the CPU 32 (see FIG. 1).

[Automatic Screw Tightening Control Method (4)]

This control method (4) is an automatic screw tightening control method in which a target rotation amount is set simply instead of the target rotation amount setting method by the rotation amount detecting means 24 performed in the above-described automatic screw tightening control methods (1) and (2). That is, in the above-described automatic screw tightening control methods (1) and (2), as illustrated in FIG. 2, in setting of the target rotation amount by the rotation amount detecting means 24, in the predetermined screw tightening operation by drive of the electric driver 10 in advance, the rotation amount Rm of the electric motor 12 from the screw-tightening start time t0 (STEP-1) to the clutch operation time t1 by the clutch mechanism 18 associated with completion of the screw tightening is detected by the rotation amount detecting means 24 (STEP-2) and recorded in the CPU 32 of the controller 30 and set in the CPU 32 as the target rotation amount Rm±α (±α is a permissible range) (STEP-3).

Thus, in this control method (4), it is configured such that a rotation amount Rm' of the electric motor 12 from the screw-tightening start time scheduled by an advance trial and the like based on a standard of a screw to be used in advance to the clutch operation time t1 by the clutch mechanism 18 associated with completion of the screw tightening is set to be a target rotation amount Rm'±α (±α is a permissible range).

Therefore, in this control method, in the required screw tightening operation (see STEP-6 to STEP-8 in FIG. 2), the rotation amount of the electric motor 12 from the screw tightening start time t0 (t0') to the clutch operation time t1 by the clutch mechanism 18 associated with completion of the screw lightening is sequentially detected by the rotation amount detecting means 24, and the rotation amount Rt1 detected at the clutch operation time t1 is compared with the target rotation amount Rm'±α (including the permissible range) so that acceptability determination of the screw tightened state can be appropriately achieved totally similarly to the above-described automatic screw tightening control methods (1) and (2).

In this control method (4), it can be also so configured that, a configuration in which the load current value It1 at the clutch operation time t1 is detected by the above-described load current detecting means 26 and is compared with the target load current value Im±β is set to be used at the same time.

[Configuration of Automatic Screw Tightening Control Device (2)]

Figure 11:
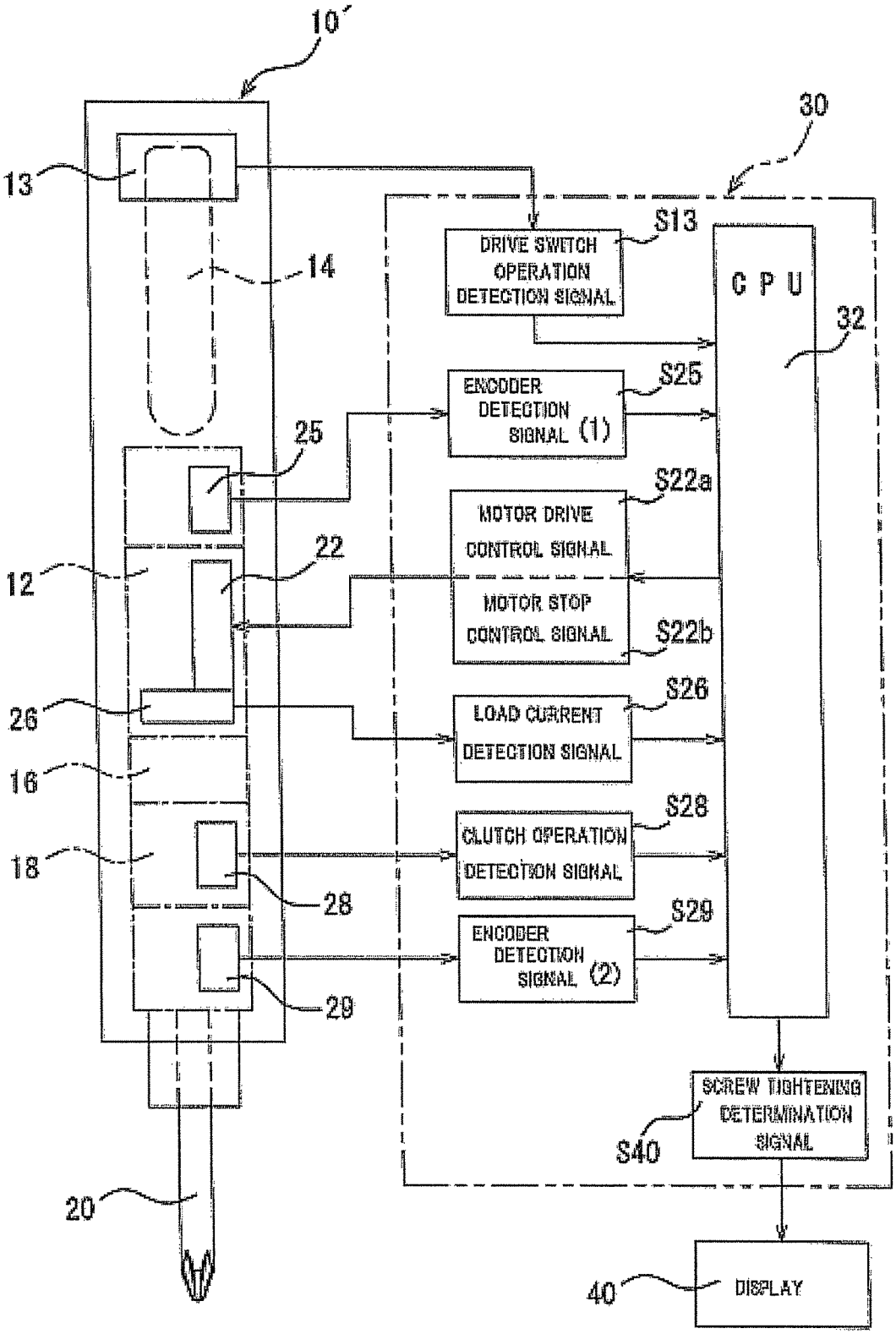
FIG. 11 is an explanatory diagram illustrating a schematic configuration illustrating another embodiment of a device for performing the screw tightening control method according to the present invention and its control system.

FIG. 11 is a schematic configuration explanatory diagram illustrating another embodiment of a device performing the automatic screw tightening control method according to the present invention. For convenience of explanation, the same constituent elements as those in the above-described device of the embodiment illustrated in FIG. 1 are given the same reference numerals since they have the same functions and the detailed explanation will be omitted.

That is, in an electric driver 10' in this embodiment, in order to enable application of an electric motor other than a brushless motor as the electric motor 12, a configuration of attaching a first encoder 25 composed of a known rotary encoder to the drive shaft of the electric motor 12 as the rotation amount detecting means of the electric motor 12 is used. Therefore, in this embodiment, the rotation amount of the electric motor 12 can be set by inputting an encoder detection signal S25 detected by the first encoder 25 into the CPU 32 of the control portion 30 as the rotation amount detecting means. In this case, the encoder detection signal S25 detected by the first encoder 25 can be detected/recorded as a rotation amount correlating to a screw tightening rotation amount in the screw tightening operation of the driver bit 20 rotated by the electric motor 12.

Moreover, in the electric driver 10' of this embodiment, a configuration in which a second encoder 29 composed of a known rotary encoder coupled with the driver bit 20 is attached as the rotation amount detecting means of the driver bit 20 can be used. Therefore, the rotation amount of the driver bit 20 can be set by inputting the encoder detection signal S29 detected by the second encoder 29 into the CPU 32 of the control portion 30 as the rotation amount detecting means. In this case, the encoder detection signal S29 detected by the second encoder 29 can be detected/recorded as the rotation amount correlating to the screw tightening rotation amount in the screw tightening operation by rotation of the driver bit 20.

In the electric driver 10' of this embodiment, the other configurations are the same as those of the above-described embodiment and thus, in the CPU 32 of the control portion 30, similarly to the above-described embodiment, if acceptability of the above-described respective screw tightened states is determined by comparing the target rotation amount Rm±α set in advance with the rotation amount Rt1 detected at the clutch operation time t1, and/or if acceptability of the above-described respective screw tightened states is determined by comparing the target load current value Im±β set in advance with the load current value It1 detected at the clutch operation time t1, it is configured such that the respective determination contents are displayed on the display 40 as appropriate by either of the above-described screw tightening determination signal S40 outputted from the CPU 32.

As described in this embodiment, by using the first encoder 25 or the second encoder 29 for detecting the rotation amount correlating to the screw tightening rotation amount in the screw tightening operation of the driver bit 20, the screw-tightening start time t0' when the screw tightening operation is performed can be detected/recorded appropriately and easily.

As is obvious from the above-described various embodiments, according to the automatic screw tightening control method and the device according to the present invention, in the predetermined screw tightening operation using various screws and the like, in detection of the rotation amount of the electric motor from start of the screw tightening to a required screw hole until the screw is seated, if approximately 50% can be confirmed, a half of troubles causing defective screw tightening in the screw tightening operation can be confirmed and solved. That is, some of so-called four big troubles in the screw tightening operation, that is, (1) galling of a screw generated at an entrance of diagonal tightening into a prepared hole of a screw; and (2) screw lifting in which torque-up is caused before seating of the screw due to nonconformity of a work and a prepared hole generated in tightening of a tapping screw and the like can be confirmed, respectively. These troubles are caused during a period from start of the screw tightening to approximately a half of the length dimension of the screw. After these situations are cleared, until a specified screw tightening torque after the screw is seated is reached, (3) if come-out is caused by abrasion of the bit or the like, and the specified screw tightening torque cannot be achieved, and (4) defective tightening of the screw caused by friction loss on the prepared hole or the like, the four big troubles of the screw tightening operation as described above can be detected easily and reliably without requiring skills, respectively, whereby an excellent working effect can be obtained by detecting and confirming the rotation amount of the electric motor and the torque-up signal by the clutch mechanism.

Moreover, according to the automatic screw tightening control method and the device according to the present invention, in the required screw tightening operation, when a plurality of screws set in advance is sequentially tightened, acceptability determination of the above-described screw tightened state for each of the screws is detected/recorded, and detection/recording of the number of tightened screws can be performed at the same time, and construction of a production line performing various screw tightening operations and a production management system in their networks can be realized easily.

Particularly, according to the automatic screw tightening control method and the device according to the present invention, in the required screw tightening operation, by appropriately detecting the rotation amount of the electric motor by the electric driver by using the clutch mechanism, completion (screw seated) state of the appropriate screw tightening is determined easily and reliably, and in the relation with the number of screws performing a large number of continuous screw-tightening sessions, the respective screw tightened states can be recorded or displayed. Moreover, at the clutch operation time in the respective screw tightening operations, by detecting/recording the load current of the electric motor, the load current value at the clutch operation time can be confirmed with an extremely accurate correlation with the screw tightening torque value of the screw which has completed screw tightening (has been seated) and thus, by setting so that the load current value of the electric motor is combined with detection of the rotation amount of the electric motor and detected/recorded or displayed, construction of the production line performing various screw tightening operations and the production management system in their networks can be easily realized.

As preferred embodiments of the present invention, the case in which the screw tightening control is executed by using a normal screw to a target with a normal screw hole provided has been described, but such embodiments are not limiting but the present invention can be also applied to screw tightening control using a tapping screw or a drill screw, for example, or screw working by tapping. Moreover, as the above-described preferred embodiment described above, the case in which a point of time (timing) when the screw is seated in the screw tightening operation is set or configured to be detected by a clutch mechanism is described, but in the present invention, without providing the clutch mechanism, it can be configured such that a required output signal is generated when the respective detected rotation amount and load current value matches the target rotation amount and the target load current value set in advance as timing for detecting the rotation amount of the electric motor or for detecting the load current value, for example, and the timing can be configured to be set. Many other design changes can be made within a range not departing from the spirit of the present invention.

DESCRIPTION OF THE REFERENCE SYMBOLS

10: electric driver
12: electric motor
13: drive switch
14: switch operating member
16: reduction gear mechanism
18: clutch mechanism
20: driver bit
22: electric motor control circuit
24: rotation amount detecting means
25: first encoder (rotation amount detecting means)
26: load current detecting means
28: clutch operation detection sensor
29: second encoder (rotation amount detecting means)
30: control portion
32: CPU
40: display
S13 drive switch operation signal
S22*a* motor drive control signal
S22*b* motor stop control signal
S24 rotation amount detection signal
S25 encoder detection signal
S26 load current detection signal
S28 clutch operation detection signal
S29 encoder detection signal
S40 screw tightened state determination signal
Rm±α target rotation amount (including permissible range)
Im±β target load current value (including permissible range)
t0 electric motor drive start time/screw-tightening start time
t0' screw-tightening start time (by push operation switch)
t1 clutch operation time
Rt1 rotation amount at clutch operation time or non-operation time
It1, It1' load current detection value of clutch operation time

The invention claimed is:

1. An automatic screw tightening control method for an electric driver comprising an electric motor, a drive switch configured to drive the electric motor, a driver bit coupled to a drive output shaft of the electric motor via a reduction gear mechanism and a clutch mechanism, a switch operating member configured to operate the drive switch, a clutch operation detection sensor configured to detect a clutch operation of the clutch mechanism, an electric motor control circuit configured to execute drive and stop control of the electric motor, and rotation amount detecting means for detecting a rotation amount of the electric motor, the method comprising:

a first step of setting a screw-tightening start time for performing a first screw tightening operation based on an operation signal of an operation switch or an encoder, and setting a clutch operation time of the clutch mechanism detected by the clutch operation detection sensor as a clutch operation time of completion of screw tightening, wherein the operation switch or the encoder generates the operation signal upon contact of the driver bit with a predetermined screw mounting target;

a second step of, during the first screw tightening operation, detecting and recording, by the rotation amount detecting means, the rotation amount of the electric motor from the screw-tightening start time until the clutch operation time of completion of screw tightening, wherein the detected and recorded rotation amount, at the clutch operation time of completion of screw tightening, is set as a target rotation amount, and wherein the target rotation amount includes a range of permissible rotation amounts; and a third step of, in a subsequent predetermined screw tightening operation, detecting and recording, by the rotation amount detecting means, a second rotation amount of the electric motor from a second screw-tightening start time until a second clutch operation time of completion of screw tightening, wherein the second rotation amount is compared with the target rotation amount to determine acceptability of a screw tightened state, wherein the second screw-tightening start time is set based on a second operation signal of the operation switch or the encoder, and wherein the third step is repeated in further subsequent predetermined screw tightening operations.

2. The automatic screw tightening control method according to claim 1, wherein, in the subsequent predetermined screw tightening operation, incremental amounts of rotation of the electric motor detected from the second screw-tightening start time until the second clutch operation time in the subsequent predetermined screw tightening operation are sequentially added to generate the second rotation amount.

3. The automatic screw tightening control method according to claim 1, wherein, in a second subsequent predetermined screw tightening operation, incremental amounts of rotation of the electric motor detected until a third clutch operation time in the second subsequent predetermined screw tightening operation are sequentially subtracted from the target rotation amount to generate a final detected value, a second target rotation amount is set to be zero, and the final detected value is compared with the second target rotation amount to determine the acceptability of the screw tightened state.

4. The automatic screw tightening control method according to claim 1, wherein if the rotation amount of the electric motor detected at the clutch operation time matches the target rotation amount set in advance, and/or if a load current detected value detected at the clutch operation time matches a target load current value set in advance, the screw tightened state is determined to be appropriate.

5. The automatic screw tightening control method according to claim 1, wherein if the rotation amount of the electric motor at the clutch operation time does not match the target rotation amount set in advance, and/or if a load current detected value at the clutch operation time does not match a target load current value set in advance, the screw tightened state is determined to be defective.

6. The automatic screw tightening control method according to claim 1, wherein if the rotation amount of the electric motor detected at the clutch operation time and/or a load current detected value detected at the clutch operation time matches the target rotation amount and/or a target load current value, respectively, a number of screws and/or a length dimension of a screw is recorded.

7. The automatic screw tightening control method according to claim 1, further comprising:

determining a length of a screw tightened during the subsequent predetermined screw-tightening operation based on the second rotation amount detected at the second clutch operation time; and displaying the length.

8. An automatic screw tightening control device comprising:

an electric driver comprising an electric motor, a drive switch configured to drive the electric motor, a driver bit coupled to a drive output shaft of the electric motor via a reduction gear mechanism and a clutch mechanism, a switch operating member for operating the drive switch, a clutch operation detection sensor configured to detect a clutch operation of the clutch mechanism, an electric motor control circuit configured to execute and stop control of the electric motor, and rotation amount detecting means for detecting a rotation amount of the electric motor;

a control portion comprising:

screw tightening time setting means for setting a screw-tightening start time for performing a first screw tightening operation responsive to an operation signal of an operation switch or of an encoder generated based on contact of the driver bit with a predetermined screw mounting target;

clutch operation time setting means for setting a clutch operation time of the clutch mechanism detected by the clutch operation detection sensor as a clutch operation time of completion of screw tightening;

target rotation amount setting means for, during performance of the first screw tightening operation, setting a detected and recorded rotation amount as a target rotation amount, wherein a rotation amount of the electric motor from the screw-tightening start time until the clutch operation time of completion of screw tightening is detected and recorded by the rotation amount detecting means, and wherein the target rotation amount includes a range of permissible rotation amounts; and determining means for, in a subsequent predetermined screw tightening operation, comparing a second rotation amount detected with the target rotation amount to determine acceptability of a screw tightened state, wherein in the subsequent predetermined screw tightening operation, the screw tightening time setting means sets a second screw-tightening start time for performing the subsequent predetermined screw tightening operation responsive to a second operation signal of the operation switch or of the encoder, wherein the second rotation amount corresponds to rotation of the electric motor from the second screw-tightening start time until a second clutch operation time of completion of screw tightening and is detected and recorded by the rotation amount detecting means, and wherein in further subsequent predetermined screw tightening operations, the determining means compares detected rotation amounts to the target rotation amount to determine acceptability of screw tightened states.

9. An automatic tightening control method comprising:

at an electric driver comprising an electric motor, a driver bit coupled to a drive output shaft of the electric motor via a clutch mechanism, a clutch operation detection sensor for detecting operation of the clutch mechanism, an electric motor control circuit for executing driving and stop control of the electric motor, and rotation amount detecting means for detecting a rotation amount of the electric motor, performing:

initiating a first tightening operation, the first tightening operation including:

detecting a tightening start time for performing the first tightening operation based on an operation signal of an operation switch or an encoder;

detecting, by the clutch operation detection sensor, a clutch operation end time of the clutch mechanism for completing the first tightening operation; and detecting, by the rotation amount detecting means, the rotation amount of the electric motor from the tightening start time until the clutch operation end time;

setting the detected rotation amount, at the clutch operation end time, as a target rotation amount; and initiating a second tightening operation subsequent the first tightening operation, wherein the second tightening operation includes:

detecting a second tightening start time for performing the second tightening operation based on a second operation signal of the operation switch or of the encoder, detecting, by the rotation amount detecting means, a second rotation amount of the electric motor, and comparing the second rotation amount with the target rotation amount to determine a tightened state.

10. The automatic tightening control method according to claim 9, wherein the target rotation amount includes a range of rotation values.

11. The automatic tightening control method according to claim 9, further comprising generating, by the operation switch or the encoder, the operation signal upon contact of the driver bit with a mounting target.

12. An automatic tightening control device comprising:

an electric driver comprising:

an electric motor comprising a drive output shaft;

a clutch mechanism;

a driver bit coupled to the drive output shaft via the clutch mechanism;

a clutch operation detection sensor configured to detect operation of the clutch mechanism;

an electric motor control circuit configured to execute drive and stop control of the electric motor; and rotation amount detecting means for detecting and recording a rotation amount of the electric motor from a tightening start time until a clutch operation time;

a controller configured to:

detect a tightening start time for performing a first tightening operation based on an operation signal of an operation switch or of an encoder;

detect a clutch operation time of completion of the first tightening operation based on a clutch operation of the clutch mechanism detected by the clutch operation detection sensor;

set a first detected rotation amount, detected and recorded by the rotation amount detecting means during the first tightening operation, as a target rotation amount;

detect a second tightening start time for performing a second tightening operation based on a second operation signal of the operation switch or of the encoder; and for the second tightening operation that is subsequent to the first tightening operation, compare a second rotation amount, determined by the rotation amount detecting means during the subsequent tightening operation, to the target rotation amount to determine a tightened state.

13. The automatic tightening control device according to claim 12, further comprising the operational switch configured to generate the operation signal upon contact of the driver bit with a mounting target.

14. The automatic tightening control device according to claim 12, further comprising the encoder configured to generate the operation signal upon contact of the driver bit with a mounting target.

15. The automatic tightening control device according to claim 12, wherein:

the first and second tightening operations are configured to tighten a screw, the target rotation amount includes a range of rotation values, and the range of rotation values includes values of the target rotation amount plus or minus a tolerance value.

16. The automatic tightening control device according to claim 12, wherein the automatic tightening control device comprises a push-operation tightening control device.

17. The automatic tightening control device according to claim 12, wherein the electric driver comprises the operation switch, the operation switch being a push-button operation switch configured to generate the operation signal, wherein activation of the electric motor is based on the operation signal.

18. The automatic tightening control device according to claim 12, wherein the controller is further configured to:

generate a motor drive signal based on the operation signal; and send the motor drive signal to the electric motor control circuit to activate the electric motor.

19. The automatic tightening control device according to claim 12:

further comprising load current value detecting means for detecting and recording a load current value of the electric motor from the tightening start time until the clutch operation time, wherein the controller is further configured to:

set a first detected load current value, detected and recorded by the load current value detecting means during the first tightening operation, as a target load current value; and for the second tightening operation that is subsequent to the first tightening operation, compare a second load current value, determined by the load current value detecting means during the second tightening operation, to the target load current value to determine the tightened state.

* * * * *